US007985020B2

(12) United States Patent
Pappalardo

(10) Patent No.: US 7,985,020 B2
(45) Date of Patent: Jul. 26, 2011

(54) CROSS FLOW INVERSION BAFFLE FOR STATIC MIXER

(75) Inventor: Matthew E. Pappalardo, Ewing, NJ (US)

(73) Assignee: Nordson Corporation, Westlake, OH (US)

( * ) Notice: Subject to any disclaimer, the term of this patent is extended or adjusted under 35 U.S.C. 154(b) by 0 days.

(21) Appl. No.: 12/868,384

(22) Filed: Aug. 25, 2010

(65) Prior Publication Data

US 2011/0075512 A1 Mar. 31, 2011

Related U.S. Application Data

(60) Provisional application No. 61/245,771, filed on Sep. 25, 2009.

(51) Int. Cl.
*B01F 5/06* (2006.01)

(52) U.S. Cl. ..... 366/337

(58) Field of Classification Search ..... 366/336–340
See application file for complete search history.

(56) References Cited

U.S. PATENT DOCUMENTS

| | | | | |
|---|---|---|---|---|
| 3,051,453 | A * | 8/1962 | Sluijters | 366/337 |
| 3,195,865 | A * | 7/1965 | Harder | 366/337 |
| 3,239,197 | A * | 3/1966 | Tollar | 366/337 |
| 3,328,003 | A * | 6/1967 | Chisholm | 366/337 |
| 3,406,947 | A * | 10/1968 | Harder | 366/337 |
| 3,620,506 | A * | 11/1971 | So | 366/337 |
| RE28,072 | E * | 7/1974 | Sluijters | 366/337 |
| 4,632,568 | A * | 12/1986 | Emele et al. | 366/337 |
| 5,174,653 | A | 12/1992 | Halat et al. | |
| 5,851,067 | A * | 12/1998 | Fleischli et al. | 366/337 |
| 5,944,419 | A * | 8/1999 | Streiff | 366/337 |
| 6,599,008 | B2 * | 7/2003 | Heusser et al. | 366/337 |
| 6,629,774 | B1 | 10/2003 | Gruendeman | |
| 6,773,156 | B2 * | 8/2004 | Henning | 366/337 |
| 7,322,740 | B2 * | 1/2008 | Heusser et al. | 366/337 |
| 7,325,970 | B2 * | 2/2008 | Keller | 366/337 |
| 7,438,464 | B2 * | 10/2008 | Moser et al. | 366/336 |
| 7,841,765 | B2 * | 11/2010 | Keller | 366/339 |
| 2003/0048694 | A1 * | 3/2003 | Horner et al. | 366/337 |
| 2004/0008576 | A1 * | 1/2004 | Henning | 366/337 |
| 2004/0141413 | A1 * | 7/2004 | Keller | 366/337 |
| 2004/0195266 | A1 * | 10/2004 | Hosozawa | 222/145.5 |
| 2006/0187752 | A1 * | 8/2006 | Keller | 366/337 |
| 2006/0245299 | A1 * | 11/2006 | Heusser et al. | 366/336 |
| 2007/0246482 | A1 | 10/2007 | Goldberg et al. | |
| 2008/0232191 | A1 * | 9/2008 | Keller | 366/339 |
| 2009/0310437 | A1 * | 12/2009 | Pappalardo | 366/337 |
| 2011/0075512 | A1 * | 3/2011 | Pappalardo | 366/337 |

FOREIGN PATENT DOCUMENTS

| | | | |
|---|---|---|---|
| WO | 2009/021033 | A1 | 2/2009 |
| WO | 2010/009247 | A2 * | 1/2010 |

* cited by examiner

*Primary Examiner* — Charles E Cooley
(74) *Attorney, Agent, or Firm* — Wood, Herron & Evans, L.L.P.

(57) ABSTRACT

A cross flow inversion mixing baffle that mixes a fluid flow and addresses the streaking phenomenon of the fluid flow in a motionless mixer, the cross flow inversion baffle including a divider wall having first and second sides. On each side of the divider wall, the cross flow inversion baffle includes a perimeter flow diverter, a center-to-perimeter flow portion, and a perimeter-to-center flow portion. The cross flow inversion baffle acts to split the fluid flow so that the fluid in opposing halves of the perimeter of the fluid flow are directed towards opposing halves of the center of the fluid flow, while the center of the fluid flow is split and directed towards opposing halves of the perimeter of the fluid flow.

10 Claims, 17 Drawing Sheets

CROSS FLOW INVERSION BAFFLE FOR STATIC MIXER

CROSS-REFERENCE TO RELATED APPLICATION

This application claims the priority of U.S. Provisional Patent Application Ser. No. 61/245,771, filed on Sep. 25, 2009, the disclosure of which is incorporated by reference herein.

FIELD OF THE INVENTION

The present invention generally relates to a fluid dispenser and more particularly, to components of a static mixer.

BACKGROUND

A number of motionless mixer types exist, such as Multiflux, helical and others. These mixer types, for the most part, implement the same general principle to mix fluids together. In these mixers, fluids are mixed together by dividing and recombining the fluids in an overlapping manner. This action is achieved by forcing the fluid over a series of baffles of alternating geometry. Such division and recombination causes the layers of the fluids being mixed to thin and eventually diffuse past one another. This mixing process has proven to be very effective, especially with high viscosity fluids. Static mixers are typically constructed of a series of alternating baffles, of varying geometries, usually consisting of right-handed and left-handed mixing baffles disposed in a conduit to perform the continuous division and recombination. Such mixers are generally effective in mixing together most of the mass fluid flow, but these mixers are subject to a streaking phenomenon, which is a tendency to leave streaks of completely unmixed fluid in the extruded mixture. The streaking phenomenon often results from streaks of fluid forming along the interior surfaces of the mixer conduit that pass through the mixer essentially unmixed.

There have been attempts made to maintain adequate mixer length while trying to address the streaking phenomenon. Much of this effort has focused on using a combination of mixing baffles of varying degrees of twist (e.g., using 90° baffles in combination with 180° or 270° baffles). In such designs, the bulk of the mixing is done in the baffles of lesser twist, which reduces the overall length of the mixer. The baffles of greater twist force the fluid from the periphery into the center of the mixing baffles, but such fluid is typically immediately diverted back to the outer periphery. While such approaches do reduce the size of the streaks, the mixing is less efficient because more baffles must be placed in the mixer to thoroughly diffuse these streaks, thus increasing the mixer's length. Such an increase in mixer length can be unacceptable in many motionless mixer applications, such as handheld mixer-dispensers. In addition, longer mixers will generally have a higher retained volume, and higher resulting material waste.

A flow inversion baffle is described in U.S. Pat. No. 6,773,156 to Henning (the Henning '156 patent), the disclosure of which is incorporated by reference herein. The flow inversion baffle produces two flow paths for viscous fluid passing through the mixer. The first flow path redirects fluid from the center of the flow stream to the periphery of the flow stream, while the second flow path redirects fluid from the periphery of the flow stream to the center of the flow stream. It would be desirable to address the streaking phenomenon and further improve the flow inversion baffle.

SUMMARY OF THE INVENTION

According to one aspect of the invention, a cross flow inversion baffle for mixing a fluid flow includes a divider wall having a first side and a second side. The cross flow inversion baffle includes a first perimeter flow diverter and a second perimeter flow diverter. A first center-to-perimeter flow portion is disposed partially between the first perimeter flow diverter and the first side of the divider wall, the first center-to-perimeter flow portion having a first chamber wall defining a first flow chamber. A first perimeter-to-center flow portion is disposed partially between the first perimeter flow diverter and the first side of the divider wall, the first perimeter-to-center flow portion having a second chamber wall defining a second flow chamber. A second center-to-perimeter flow portion is disposed partially between the second perimeter flow diverter and the second side of the divider wall, the second center-to-perimeter flow portion having a third chamber wall defining a third flow chamber. A second perimeter-to-center flow portion is disposed partially between the second perimeter flow diverter and the second side of the divider wall, the second perimeter-to-center flow portion having a fourth chamber wall defining a fourth flow chamber.

The fluid flow is mixed by moving the fluids flowing in the center of the fluid flow to the perimeter of the fluid flow and by also moving the fluids from the perimeter of the fluid flow to the center of the fluid flow. The fluid flow is also mixed together by dividing the flow with the divider wall and directing each half of the center and perimeter portions of the fluid flow in opposite lateral directions toward opposite walls. These mixing effects help prevent streaks that form in the periphery of the fluid flow on opposite side walls from combining into a unified streak in the center of the fluid flow. The divider wall, flow diverters, center-to-perimeter flow portions, and perimeter-to-center flow portions can be integrally formed or injection molded.

The cross flow inversion baffle may include a first flow inverter half and a second flow inverter half. The first flow inverter half includes the first perimeter flow diverter, the first center-to-perimeter flow portion, and the first perimeter-to-center flow portion. The second flow inverter half includes the second perimeter flow diverter, the second center-to-perimeter flow portion, and the second perimeter-to-center flow portion. The first flow inverter half and the second flow inverter half are substantially identical, but are oriented to be rotated 180 degrees from each other on opposite sides of the divider wall.

These and other objects and advantages of the present invention will become more readily apparent during the following detailed description taken in conjunction with the drawings herein.

BRIEF DESCRIPTION OF THE DRAWINGS

The accompanying drawings, which are incorporated in and constitute a part of this specification, illustrate embodiments of the invention and, together with a general description of the invention given above, and the detailed description of the embodiments given below, serve to explain the principles of the invention.

DETAILED DESCRIPTION OF THE ILLUSTRATIVE EMBODIMENTS

Figure 1:
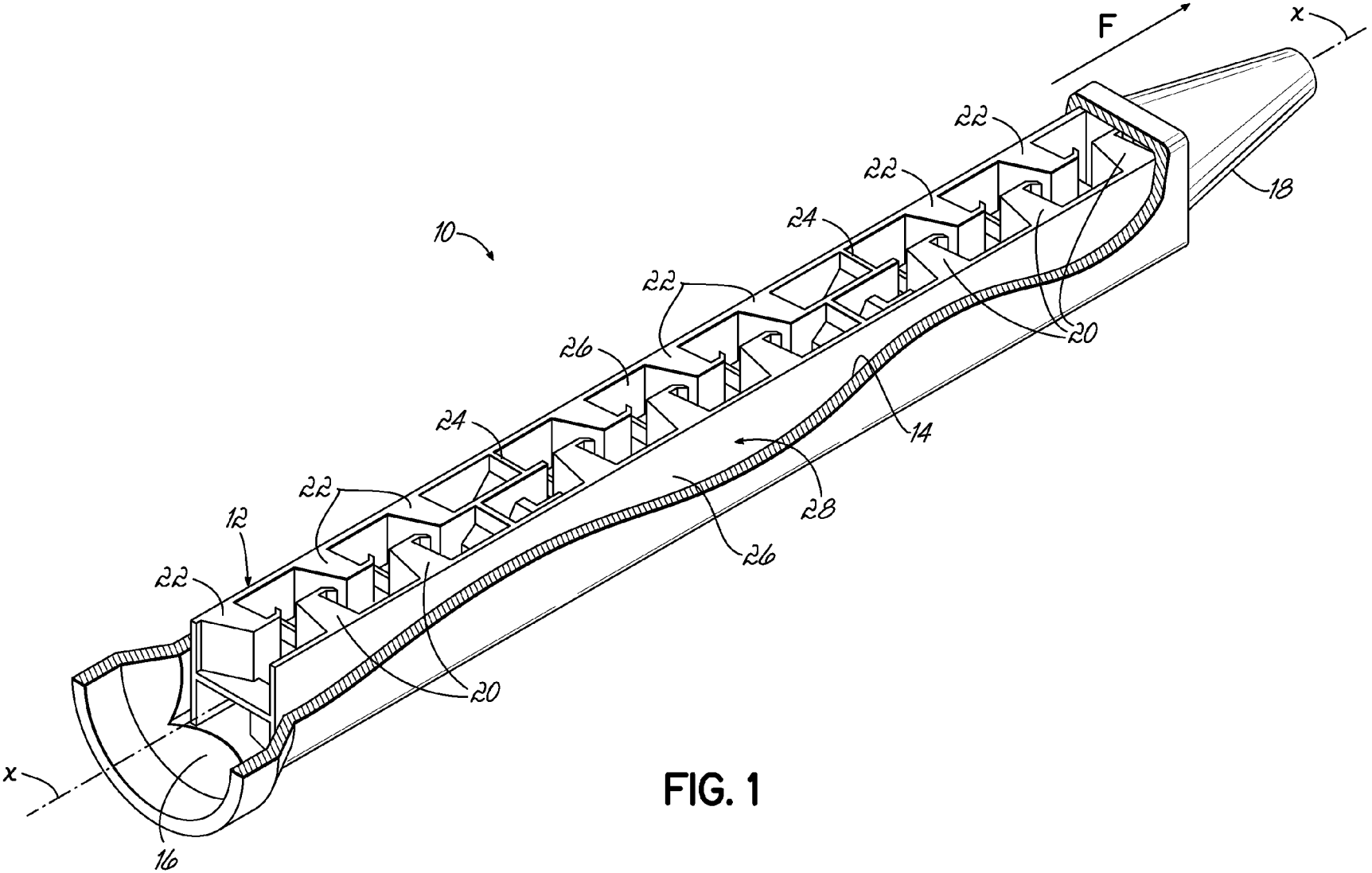
FIG. 1 is a perspective view of one embodiment of a static mixer with a portion of the mixer sidewall removed.

Referring to FIG. 1, a static mixer 10 in accordance with one embodiment of the invention includes a conduit 12 defining an interior wall 14, an inlet 16 and an outlet 18. The mixer 10 further includes a plurality of alternating left-handed mixing baffles 20 and right-handed mixing baffles 22, as well as one or more cross flow inversion baffles 24. The mixer 10 of FIG. 1 is an eighteen stage mixer having eighteen total baffles 20, 22, 24. There are eight left-handed baffles 20, eight right-handed baffles 22 and two cross flow inversion baffles 24. A person having skill in the art will recognize that a different number of total baffles 20, 22, 24 could be used in the static mixer 10 without departing from the scope of the invention. Additionally, the ratio of left-handed and right-handed baffles 20, 22 to cross flow inversion baffles 24 may also be modified without departing from the scope of the invention. The baffles 20, 22, 24 are disposed within the conduit 12 along a central, longitudinal axis X, along which inserted fluids flow in a general flow direction F. As a multi-component viscous fluid moves through the conduit 12, the plurality of baffles 20, 22, 24 induces mixing together of the two or more components of the viscous fluid.

As shown in the embodiment of FIG. 1, the plurality of baffles 20, 22, 24 may be integrally formed as a single unit. For example, the plurality of baffles 20, 22, 24 could be integrally formed by an injection molding process. Alternatively, each of the baffles 20, 22, 24 could be independently injection molded and coupled together before insertion into the mixer 10. In FIG. 1 the plurality of baffles 20, 22, 24 are also integrally formed with a pair of opposing sidewalls 26 to form a baffle assembly 28. The opposing sidewalls 26 provide support and rigidity to the individual baffles 20, 22, 24. The baffle assembly 28 can be slid into the conduit 12 through the inlet 16 to form the completed mixer 10. The opposing sidewalls 26 engage the interior wall 14 of the conduit 12 as illustrated in FIG. 1, ensuring that the viscous fluid moving through the mixer 10 flows through the baffle assembly 28.

Figure 2:
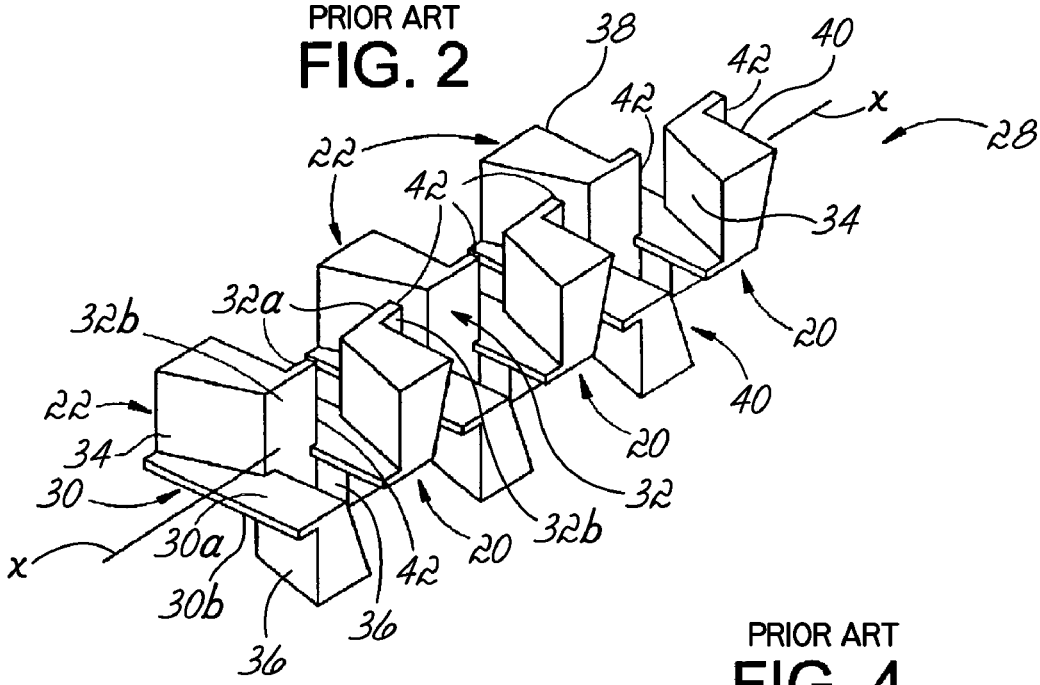
PRIOR ART FIG. 2
FIG. 2 is a perspective view of a plurality of interconnected alternating mixing baffles of FIG. 1.
Figure 4:
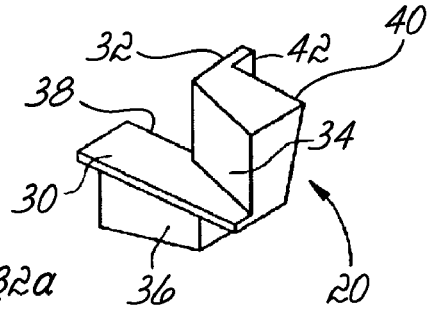
PRIOR ART FIG. 4
FIG. 4 is a perspective view of a left-handed mixing baffle of FIG. 2.
Figure 3:
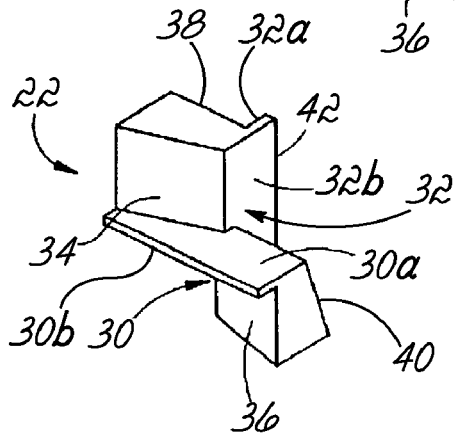
PRIOR ART FIG. 3
FIG. 3 is a perspective view of a right-handed mixing baffle of FIG. 2.

Referring to FIGS. 2-4, a portion of the baffle assembly 28 including left-handed and right-handed mixing baffles 20, 22 is depicted in detail. The following details of the left-handed and right-handed mixing baffles 20, 22 were discussed in the Henning '156 patent cited above, as the mixer 10 of the present embodiment uses these conventional mixing baffles 20, 22 with a new cross flow inversion baffle 24. As used in the following description, orientation phrases such as horizontal and vertical or upper and lower are merely exemplary and based on the flow direction of the embodiment shown in FIGS. 2-4. The right-handed mixing baffle 22 is provided with a generally planar horizontal wall 30 that has upper and lower sides 30*a*, 30*b* and a generally planar vertical wall 32 that has left and right sides 32*a* and 32*b*, as most clearly illustrated in FIG. 3. The walls 30, 32 extend generally parallel to the flow direction and intersect one another. The right-handed mixing baffle 22 further includes an upper forward angled surface 34 perpendicular to the upper side 30*a* of the horizontal wall 30 and at an angle to the general flow direction F. The right-handed mixing baffle 22 also includes a lower forward angled surface 36 perpendicular to the lower side 30*b* of the horizontal wall 30 and at an angle to the general flow direction F. On the opposite side of the upper forward angled surface 34 is a left rear angled surface 38 perpendicular to the left side 32*a* of the vertical wall 32 and at an angle to the general flow direction F. On the opposite side of the lower forward angled surface 36 is a right rear angled surface 40 perpendicular to the right side 32*b* of the vertical wall 32 and at an angle to the general flow direction F. Furthermore, the vertical wall 32 extends beyond the rear angled surfaces 38, 40 to form a rear fin 42 that extends in the flow direction.

The left-handed mixing baffle 20 is a mirror image of the right-handed mixing baffle 22, as shown in FIG. 4. The left-handed mixing baffle 20 includes each of the same elements as the right-handed mixing baffle 22, including the horizontal and vertical shelves 30, 32, the upper and lower forward angled surfaces 34, 36, the left and right rear angled surfaces 38, 40, and the rear fin 42. Each of the mixing baffles 20, 22 shown in FIGS. 2-4 divides the mass fluid flow in half at the horizontal wall 30 and then rotates the fluid ninety degrees in orientation as the fluid passes by the mixing baffles 20, 22. The left-handed mixing baffle 20 rotates the mass fluid flow in a counterclockwise direction, while the right-handed mixing baffle 22 rotates the mass fluid flow in a clockwise direction. Other embodiments of the invention may be formed from mixing baffles employing geometries differing from those described above, including spiral-shaped baffles and mixing baffles that rotate the flow 180 degrees or 270 degrees from the original flow orientation.

Figure 5A:
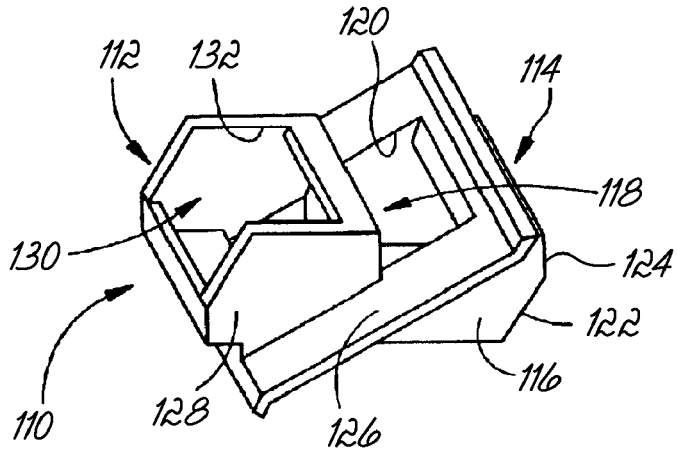
PRIOR ART FIG. 5A
FIG. 5A is a perspective view of a prior art flow inversion baffle.
Figure 5B:
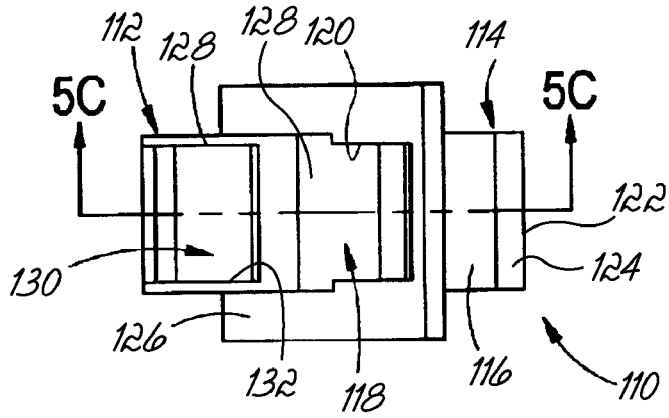
PRIOR ART FIG. 5B
FIG. 5B is a top view of the flow inversion baffle of FIG. 5A.
Figure 5C:
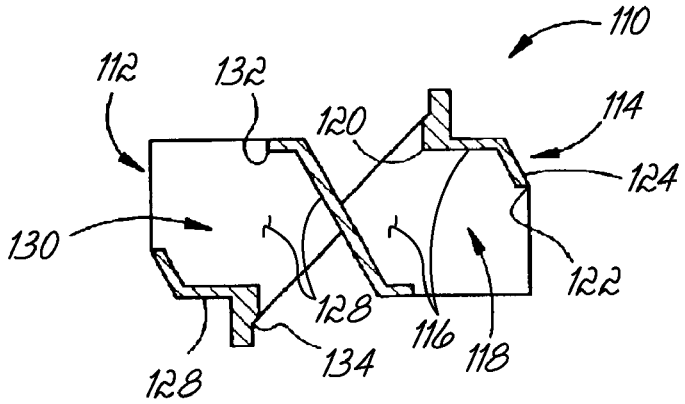
PRIOR ART FIG. 5C
FIG. 5C is a cross-sectional side view of the flow inversion baffle of FIG. 5A.
Figure 6A:
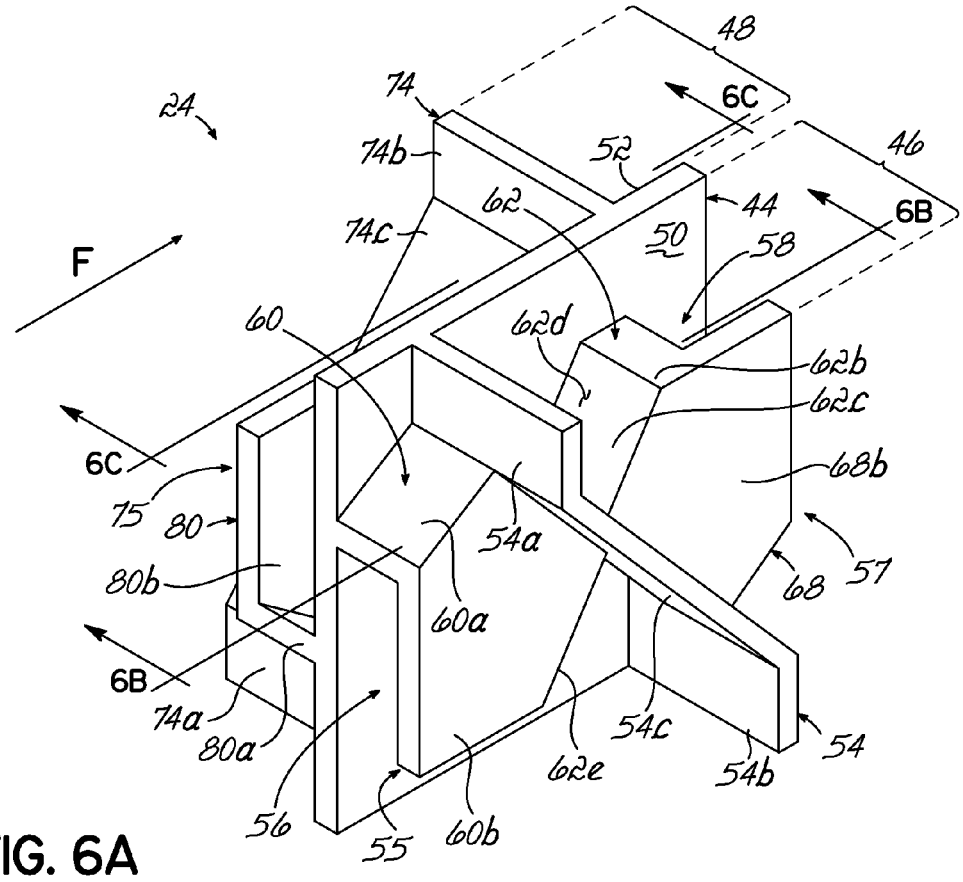
FIG. 6A is a perspective view of a cross flow inversion baffle of FIG. 1.
Figure 6B:
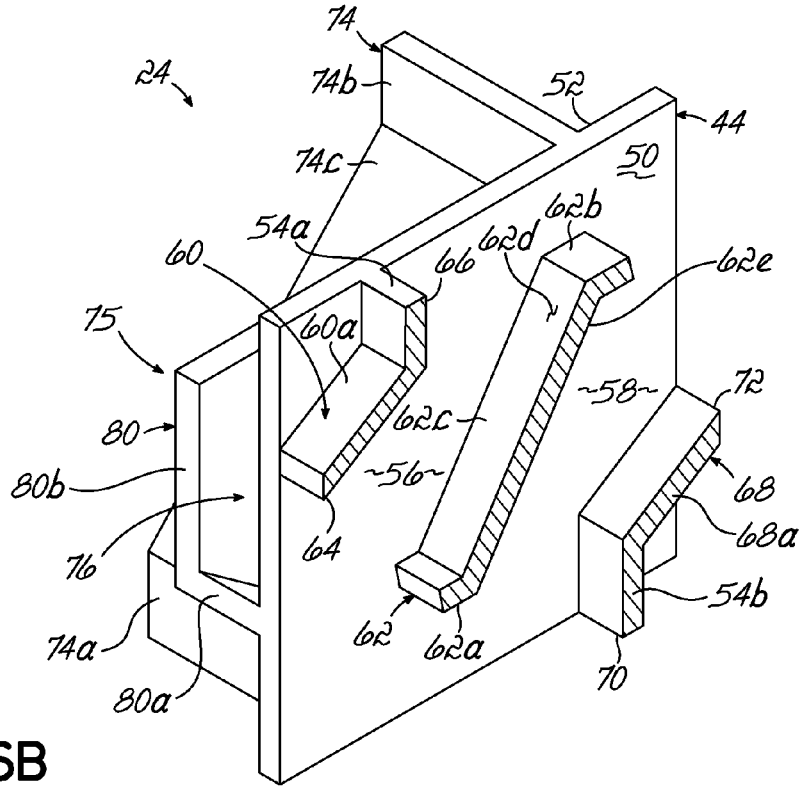
FIG. 6B is a cross-sectional perspective view of the cross flow inversion baffle of FIG. 6A along line 6B-6B, showing first and second flow chambers.
Figure 6C:
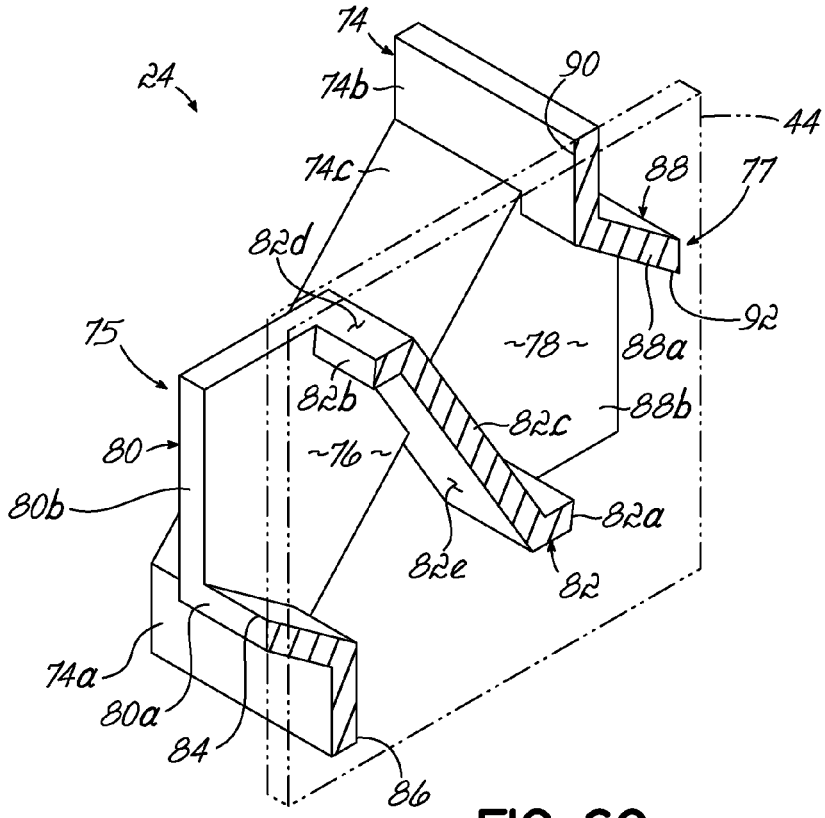
FIG. 6C is a cross-sectional perspective view of the cross flow inversion baffle of FIG. 6A along line 6C-6C, showing third and fourth flow chambers.
Figure 6D:
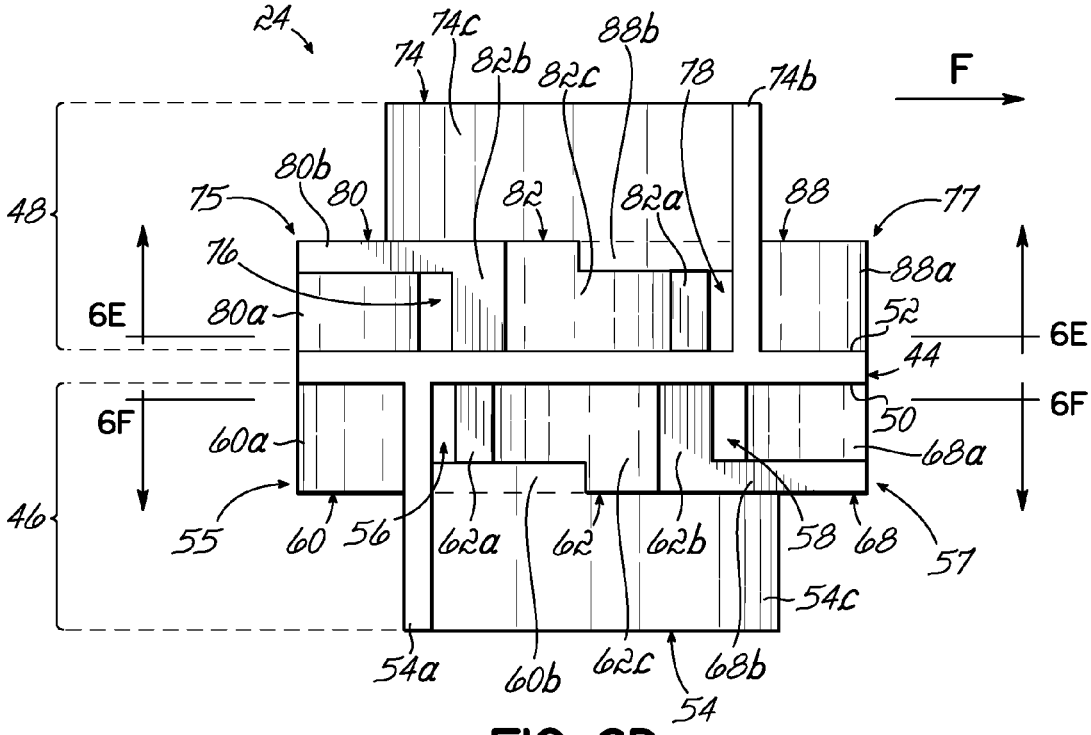
FIG. 6D is a top view of the cross flow inversion baffle of FIG. 6A.
Figure 6E:
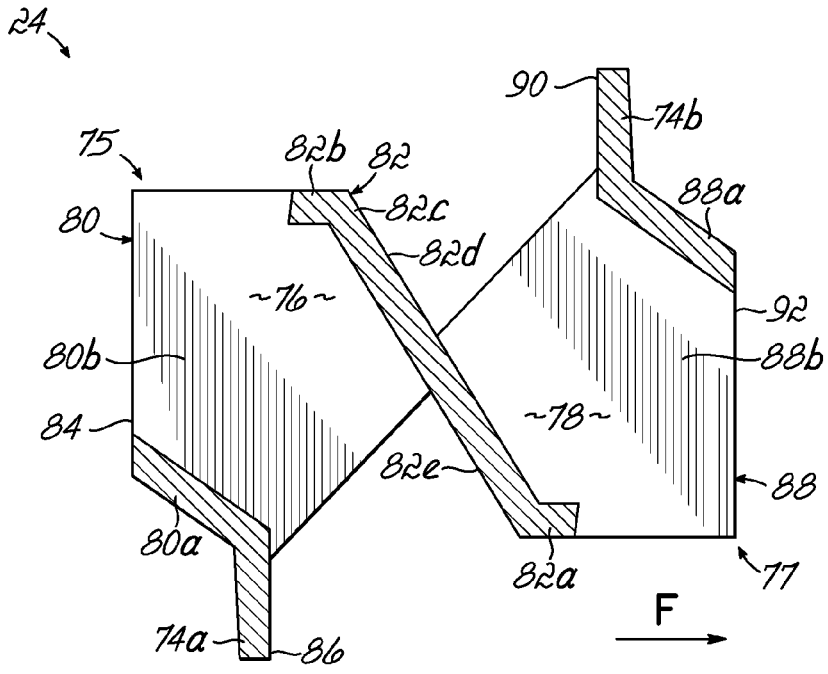
FIG. 6E is a cross-sectional side view of the cross flow inversion baffle of FIG. 6D along line 6E-6E.
Figure 6F:
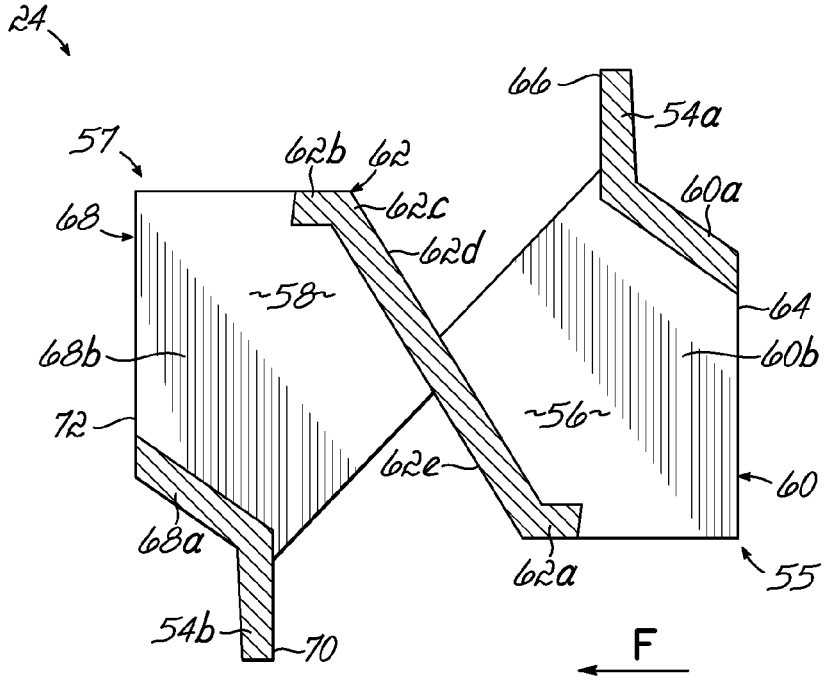
FIG. 6F is a cross-sectional side view of the cross flow inversion baffle of FIG. 6D along line 6F-6F.
Figure 6G:
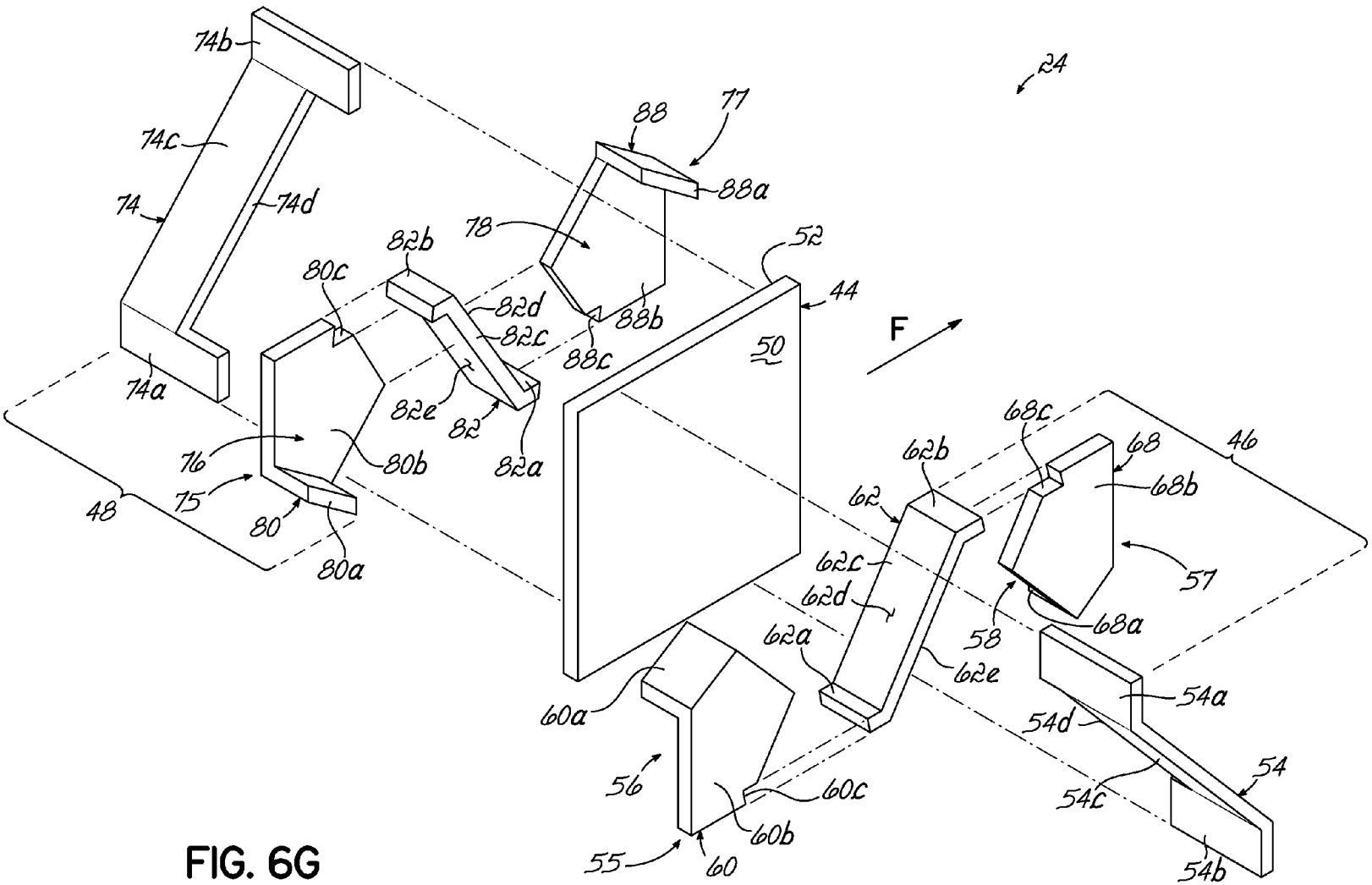
FIG. 6G is an exploded view of the cross flow inversion baffle of FIG. 6A.

Referring to FIGS. 5A-5C, a prior art flow inversion baffle 110 is depicted. The following description of the flow inversion baffle 110 was disclosed in the Henning '156 patent. The flow inversion baffle 110 includes a center-to-perimeter flow portion 112 and a perimeter-to-center flow portion 114. In the embodiment depicted, the center-to-perimeter flow portion 112 is integral with the perimeter-to-center flow portion 114. The perimeter-to-center flow portion 114 also includes a chamber wall 116 which defines a perimeter-to-center flow chamber 118. The perimeter-to-center flow chamber 118 includes an inlet 120 an outlet 122. The perimeter-to-center flow portion 114 may further include an angled baffle 124 to aid in the flow inversion process. The flow inversion baffle 110 also includes a perimeter flow diverter 126 that surrounds the center-to-perimeter flow portion 112 and defines the inlet 120 to a perimeter-to-center flow chamber 118. The perimeter flow diverter 126 can be integral with the opposing sidewalls 26 and, when inserted in the conduit 12, also contacts the conduit wall 14. The perimeter flow diverter 126 acts to direct all fluid from along the periphery of the baffle assembly 28 into the inlet 120 of the perimeter-to-center flow chamber 118. The center-to-perimeter portion 112 includes a chamber wall 128 which defines a center-to-perimeter flow chamber 130 having an inlet 132 and an outlet 134. The chamber wall 128 is integral with and surrounded by the perimeter flow diverter 126. As fluid passes through the flow inversion baffle 110, the fluids in the center of the mass fluid flow move to the perimeter of the mass fluid flow through the center-to-perimeter flow chamber 130 and the fluids in the perimeter of the mass fluid flow move to the center of the mass fluid flow through the perimeter-to-center flow chamber 118.

Referring to FIGS. 6A-6G, one embodiment of a cross flow inversion baffle 24 is illustrated. The cross flow inversion baffle 24 is a modification of the flow inversion baffle 110 as follows: the flow inversion baffle 110 is split into halves along the general flow direction F. For one half of the inversion baffle 110, a duplicate half is formed, rotated 180 degrees about the flow direction axis, and joined to the first half at a divider wall 44. The divider wall 44 includes a first side 50 and a second side 52. Thus, the cross flow inversion baffle 24 includes the divider wall 44, a first cross flow inverter half 46 coupled to the first side 50 of the divider wall 44, and a second cross flow inverter half 48 which is identical to the first cross flow inverter half 46 but rotated 180 degrees in orientation and coupled to the second side 52 of the divider wall 44.

The first cross flow inverter half 46 is more clearly illustrated in FIGS. 6B, 6D, 6F, and 6G. The first cross flow inverter half 46 includes a first perimeter flow diverter 54 including a first diverter portion 54*a*, a second diverter portion 54*b*, and a third diverter portion 54*c*. The third diverter portion 54*c* is disposed between the first and second diverter portions 54*a*, 54*b* and is angled with respect to the flow direction F. The first and second diverter portions 54*a*, 54*b* extend to the first side 50 of the divider wall 44, and the third diverter portion 54*c* includes an inner edge 54*d* (see FIG. 6G) that is spaced from the divider wall 44. The first cross flow inverter half 46 further includes a first center-to-perimeter flow portion 55 and a first perimeter-to-center flow portion 57 each partially disposed in this space between the divider wall 44 and the inner edge 54*d* of the third diverter portion 54*c*.

The first center-to-perimeter flow portion 55 includes a first flow chamber 56 defined by a first chamber wall 60 and a chamber dividing wall 62. The first chamber wall 60 includes a first chamber wall portion 60*a* engaged with the divider wall 44, a second chamber wall portion 60*b* spaced from the divider wall 44, and a notch 60*c* (see FIG. 6G) in the second chamber wall portion 60*b*. The chamber dividing wall 62 includes a first chamber dividing wall portion 62*a*, a second chamber dividing wall portion 62*b*, and a third chamber dividing wall portion 62*c*. The third chamber dividing wall portion 62*c* is disposed between the first and second chamber dividing wall portions 62*a*, 62*b* and is angled with respect to the flow direction F. The chamber dividing wall portions 62*a*, 62*b*, 62*c* collectively define an upper surface 62*d* and an opposing lower surface 62*e* (see FIG. 6G). The first chamber wall 60 and the chamber dividing wall 62 are engaged along the upper surface 62*d* such that the second chamber wall portion 60*b* engages the third chamber dividing wall portion 62*c* and the first chamber dividing wall portion 62*a* engages the notch 60*c*. The first flow chamber 56 further includes an inlet 64 and an outlet 66. In summary, the first flow chamber 56 is defined between the first side 50 of the divider wall 44, the first chamber wall 60, and the upper surface 62*d* of the chamber dividing wall 62. The first center-to-perimeter flow portion 55 may be formed integrally with the divider wall 44 and the first perimeter flow diverter 54.

The first perimeter-to-center flow portion 57 includes a second flow chamber 58 defined by a second chamber wall 68 and the chamber dividing wall 62. The second chamber wall 68 includes a first chamber wall portion 68*a* engaged with the divider wall 44, a second chamber wall portion 68*b* spaced from the divider wall 44, and a notch 68*c* (see FIG. 6G) in the second chamber wall portion 68*b*. The second chamber wall 68 and the chamber dividing wall 62 are engaged along the lower surface 62*e* such that the second chamber wall portion 68*b* engages the third chamber dividing wall portion 62*c* and the second chamber dividing wall portion 62*b* engages the notch 68*c*. The second flow chamber 58 further includes an inlet 70 and an outlet 72. In summary, the second flow chamber 58 is defined between the first side 50 of the divider wall 44, the second chamber wall 68, and the lower surface 62*e* of the chamber dividing wall 62. The first perimeter-to-center flow portion 57 may be formed integrally with the divider wall 44 and the first perimeter flow diverter 54.

As the mass fluid flow passes through the cross flow inversion baffle 24, approximately half of the center of the mass fluid flow will enter the first flow chamber 56 of the first cross flow inverter half 46 and be transferred to the perimeter of the mass fluid flow exiting the first cross flow inverter half 46. In a similar fashion, approximately half of the perimeter of the mass fluid flow entering the cross flow inversion baffle 24 will be diverted by the first perimeter flow diverter 54 into the second flow chamber 58 of the first cross flow inverter half 46 and will exit the cross flow inversion baffle 24 at the center of the mass fluid flow.

The second cross flow inverter half 48 is more clearly illustrated in FIGS. 6C, 6D, 6E, and 6G. The second cross flow inverter half 48 includes a second perimeter flow diverter 74 including a first diverter portion 74*a*, a second diverter portion 74*b*, and a third diverter portion 74*c*. The third diverter portion 74*c* is disposed between the first and second diverter portions 74*a*, 74*b* and is angled with respect to the flow direction F. The first and second diverter portions 74*a*, 74*b* extend to the second side 52 of the divider wall 44, and the third diverter portion 74*c* includes an inner edge 74*d* (see FIG. 6G) that is spaced from the divider wall 44. The second cross flow inverter half 48 further includes a second center-to-perimeter flow portion 75 and a second perimeter-to-center flow portion 77 each partially disposed in this space between the divider wall 44 and the inner edge 74*d* of the third diverter portion 74*c*.

The second center-to-perimeter flow portion 75 includes a third flow chamber 76 defined by a third chamber wall 80 and a chamber dividing wall 82. The third chamber wall 80 includes a first chamber wall portion 80*a* engaged with the divider wall 44, a second chamber wall portion 80*b* spaced from the divider wall 44, and a notch 80*c* (see FIG. 6G) in the second chamber wall portion 80*b*. The chamber dividing wall 82 includes a first chamber dividing wall portion 82*a*, a second chamber dividing wall portion 82*b*, and a third chamber dividing wall portion 82*c*. The third chamber dividing wall portion 82*c* is disposed between the first and second chamber dividing wall portions 82*a*, 82*b* and is angled with respect to the flow direction F. The chamber dividing wall portions 82*a*, 82*b*, 82*c* collectively define an upper surface 82*d* and an opposing lower surface 82*e* (see FIG. 6G). The third chamber wall 80 and the chamber dividing wall 82 are engaged along the lower surface 82*e* such that the second chamber wall portion 80*b* engages the third chamber dividing wall portion 82*c* and the second chamber dividing wall portion 82*b* engages the notch 80*c*. The third flow chamber 76 further includes an inlet 84 and an outlet 86. In summary, the third flow chamber 76 is defined between the second side 52 of the divider wall 44, the third chamber wall 80, and the lower surface 82*e* of the chamber dividing wall 82. The second center-to-perimeter flow portion 75 may be formed integrally with the divider wall 44 and the second perimeter flow diverter 74.

The second perimeter-to-center flow portion 77 includes a fourth flow chamber 78 defined by a fourth chamber wall 88 and the chamber dividing wall 82. The fourth chamber wall 88 includes a first chamber wall portion 88*a* engaged with the divider wall 44, a second chamber wall portion 88*b* spaced from the divider wall 44, and a notch 88*c* (see FIG. 6G) in the second chamber wall portion 88*b*. The fourth chamber wall 88 and the chamber dividing wall 82 are engaged along the upper surface 82*d* such that the second chamber wall portion 88*b* engages the third chamber dividing wall portion 82*c* and the first chamber dividing wall portion 82*a* engages the notch 88*c*. The fourth flow chamber 78 further includes an inlet 90 and an outlet 92. In summary, the fourth flow chamber 78 is defined between the second side 52 of the divider wall 44, the fourth chamber wall 88, and the upper surface 82*d* of the chamber dividing wall 82. The second perimeter-to-center flow portion 77 may be formed integrally with the divider wall 44 and the second perimeter flow diverter 74.

As the mass fluid flow passes through the cross flow inversion baffle 24, approximately half of the center of the mass fluid flow will enter the third flow chamber 76 of the second cross flow inverter half 48 and be transferred to the perimeter of the mass fluid flow exiting the second cross flow inverter half 48. In a similar fashion, approximately half of the perimeter of the mass fluid flow entering the cross flow inversion baffle 24 will be diverted by the second perimeter flow diverter 74 into the fourth flow chamber 78 of the second cross flow inverter half 48 and will exit the cross flow inversion baffle 24 at the center of the mass fluid flow.

Figure 7A:
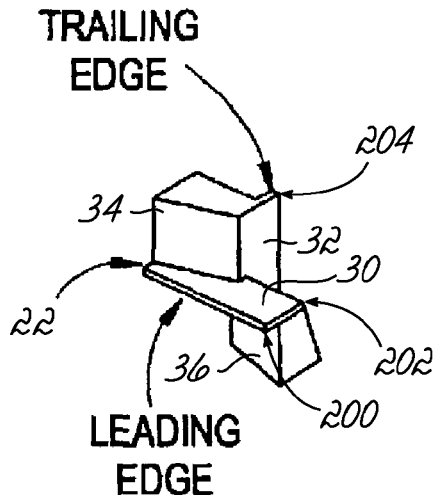
PRIOR ART FIG. 7A
FIG. 7A is a perspective view of the mixing baffle of FIG. 3.
Figure 7B:
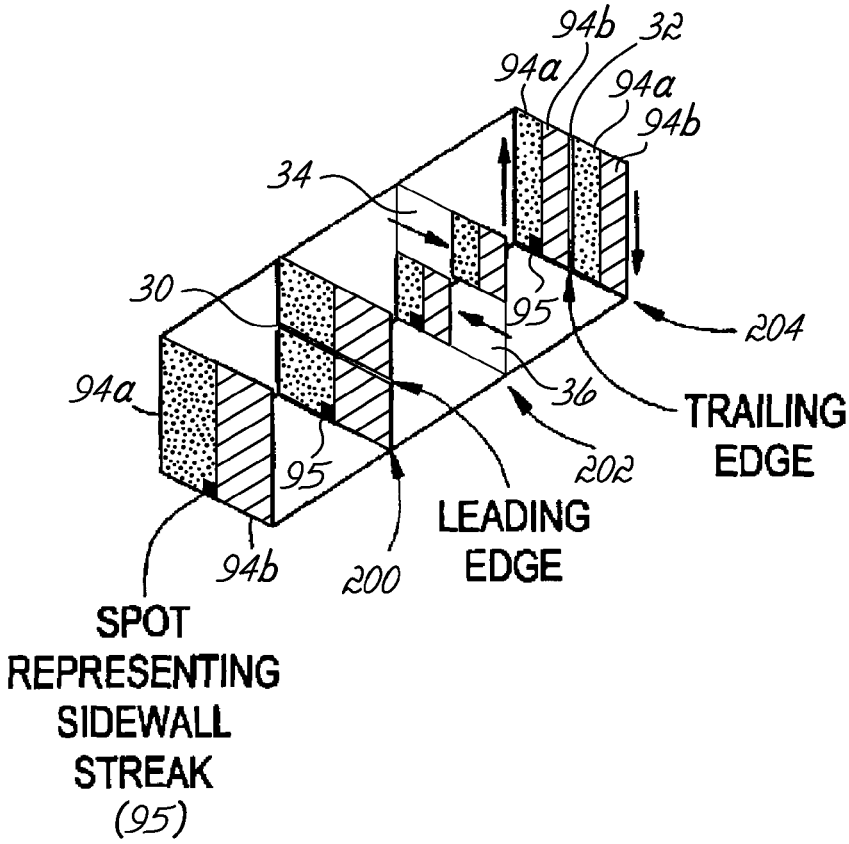
PRIOR ART FIG. 7B
FIG. 7B is a schematic illustration of the fluid flow through the mixing baffle of FIG. 7A.

Referring to FIGS. 7A and 7B, the mixing characteristics of the right-handed mixing baffle 22 of the static mixer 10 are schematically depicted. The following mixing characteristics of the mixing baffle 22 were fully disclosed in the Henning '156 patent. The mass fluid flow includes two fluids 94*a*, 94*b* introduced into the mixer 10, and a sample sidewall streak 95 has been illustrated as a spot within the mass fluid flow. As the two fluids 94*a*, 94*b* intersect the leading edge 30 of the right-handed baffle 22 at point 200 of FIG. 7B, the mass fluid flow is divided in half. As the divided fluid continues to flow through the right-handed baffle 22, the material is shifted laterally by the front angled surfaces 34, 36 at point 202. As the fluid approaches the trailing edge of the right-handed baffle 22 at point 204, the fluid flow expands to occupy the open space on both sides of the vertical wall 32.

Figure 8A:
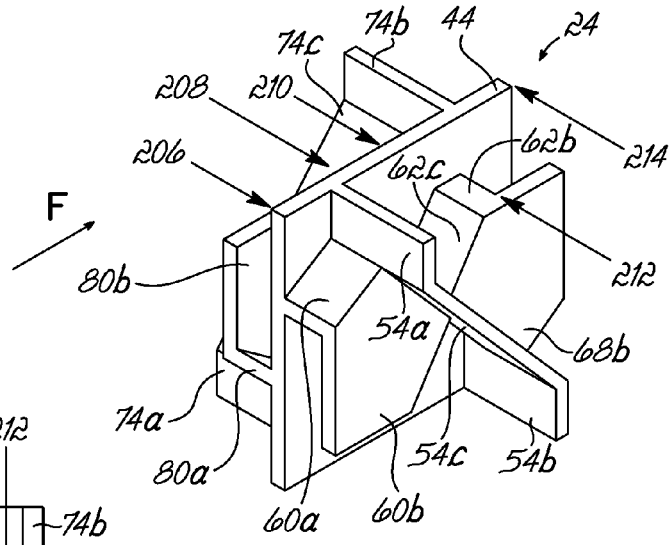
FIG. 8A is a perspective view of the cross flow inversion baffle of FIG. 6A.
Figure 8B:
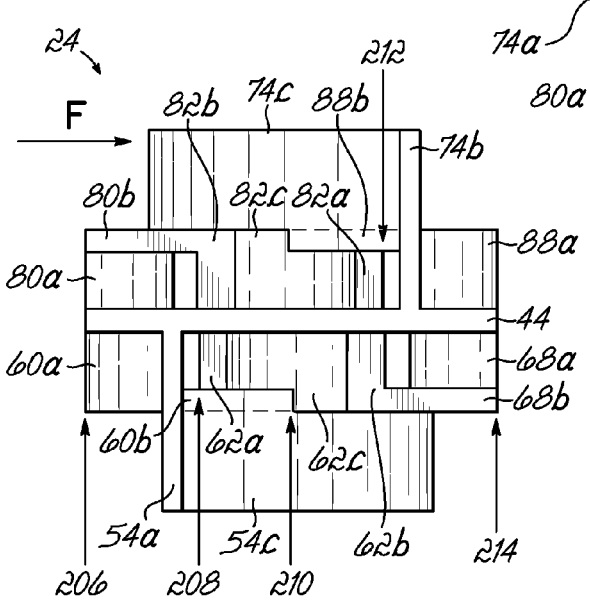
FIG. 8B is a top view of the cross flow inversion baffle of FIG. 8A.
Figure 8C:
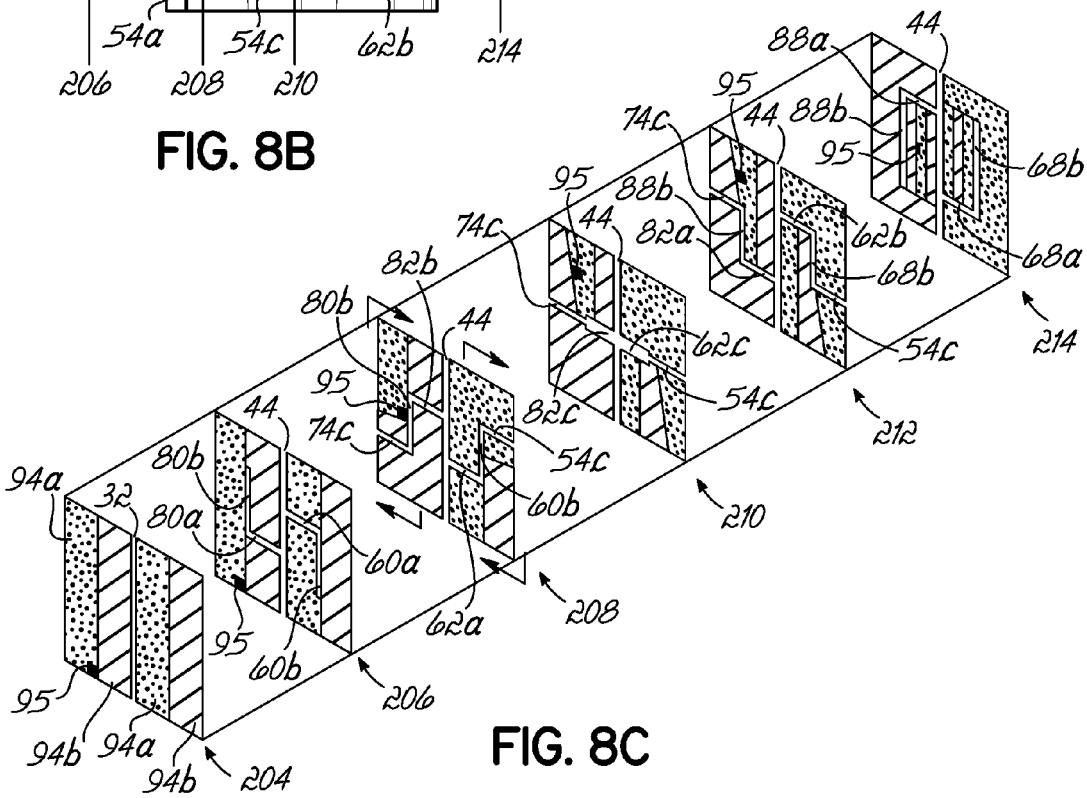
FIG. 8C is a schematic illustration of the fluid flow through the cross flow inversion baffle of FIGS. 8A and 8B.

Referring to FIGS. 8A-8C, the mixing characteristics of the cross flow inversion baffle 24 are schematically depicted. The fluid flow from point 204 in FIG. 7B continues through the cross flow inversion baffle 24 as shown in FIG. 8C. As indicated at point 206, the mass fluid flow is initially divided by divider wall 44 and the fluids moving in the center of the mass fluid flow begin to be divided from the fluids moving in the perimeter of the mass fluid flow by the first chamber wall 60 and the third chamber wall 80. As indicated at point 208, the perimeter flow diverters 54, 74 and the associated chamber dividing walls 62, 82 completely divide the fluids that were initially in the center of the mass fluid flow and the fluids that were initially in the perimeter of the mass fluid flow. Continuing through points 210 and 212, the fluids that were initially in the center of the mass fluid flow exit from the first and third flow chambers 56, 76 and begin to expand outwardly around the second and fourth chamber walls 68, 88 towards the perimeter of the mass fluid flow. At the same time, the fluids that were initially in the perimeter of the mass fluid flow travel down the first and second perimeter flow diverters 54, 74 towards the second and fourth flow chambers 58, 78. As the mass fluid flow exits the cross flow inversion baffle 24 at point 214, the fluids that were initially in the center of the mass fluid flow and the fluids that were initially in the perimeter of the mass fluid flow have been juxtaposed on both sides of the divider wall 44. For example, the sample sidewall streak 95 originally in the perimeter of the mass fluid flow has been folded into the center of the mass fluid flow as the streak 95 exits the cross flow inversion baffle 24.

Figure 9:
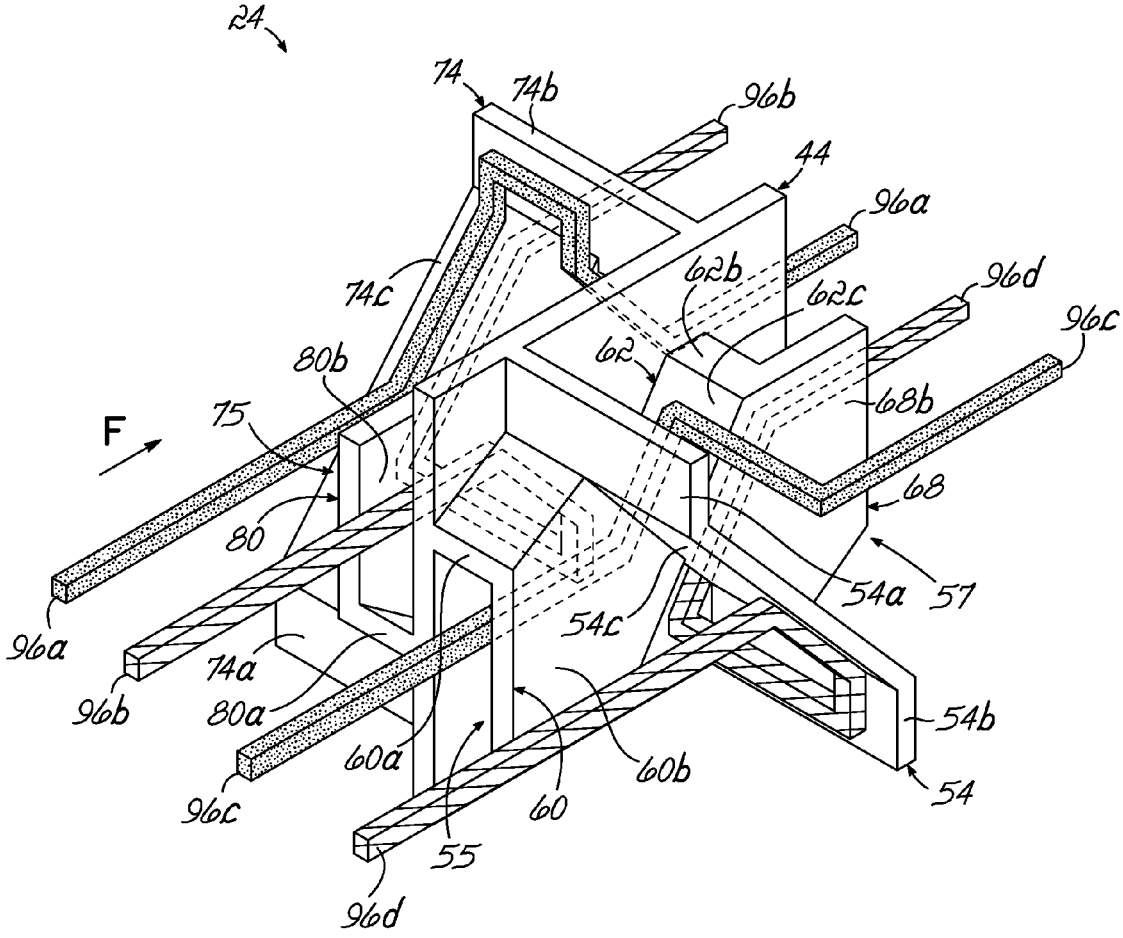
FIG. 9 is a schematic illustration of four flow paths of the fluid flow through the cross flow inversion baffle of FIG. 6A.

The fluid flow through the cross flow inversion baffle 24 is further schematically illustrated in FIG. 9. Four fluid streaks 96*a*, 96*b*, 96*c*, 96*d* are shown passing through the various flow chambers 56, 58, 76, 78 of the cross flow inversion baffle 24. The first fluid streak 96*a* begins along the perimeter of the mass fluid flow and travels along the second perimeter flow diverter 74 into the second perimeter-to-center flow portion 77, where the first streak 96*a* is directed to the center of the mass fluid flow. The second fluid streak 96*b* passes through the second center-to-perimeter flow portion 75 and then moves into the perimeter of the mass fluid flow as the flow expands to fill the perimeter of the mixer conduit 12. Similarly, the third fluid streak 96*c* passes through the first center-to-perimeter flow portion 55 and then moves into the perimeter of the mass fluid flow as shown. The fourth fluid streak 96*d* also begins along the perimeter of the mass fluid flow and travels along the first perimeter flow diverter 54 into the first perimeter-to-center flow portion 57, where the fourth streak 96*d* is directed to the center of the mass fluid flow. The paths of the four fluid streaks 96*a*, 96*b*, 96*c*, 96*d* are merely exemplary of how the mass fluid flow can be split into the respective flow portions 77, 75, 55, 57, as one having skill in the art will appreciate that a fluid streak may follow different paths than the ones illustrated.

Figure 10A:
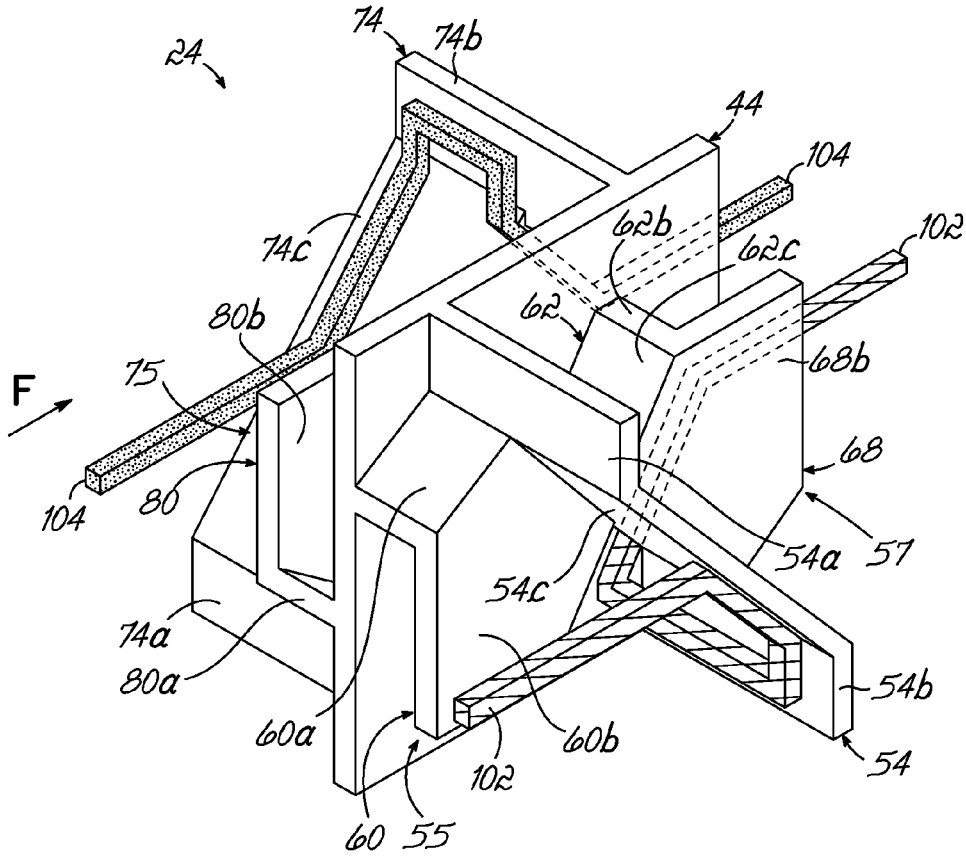
FIG. 10A is a perspective view of the cross flow inversion baffle of FIG. 6A, further illustrating the flow paths of two peripheral streaks of fluid.
Figure 10B:
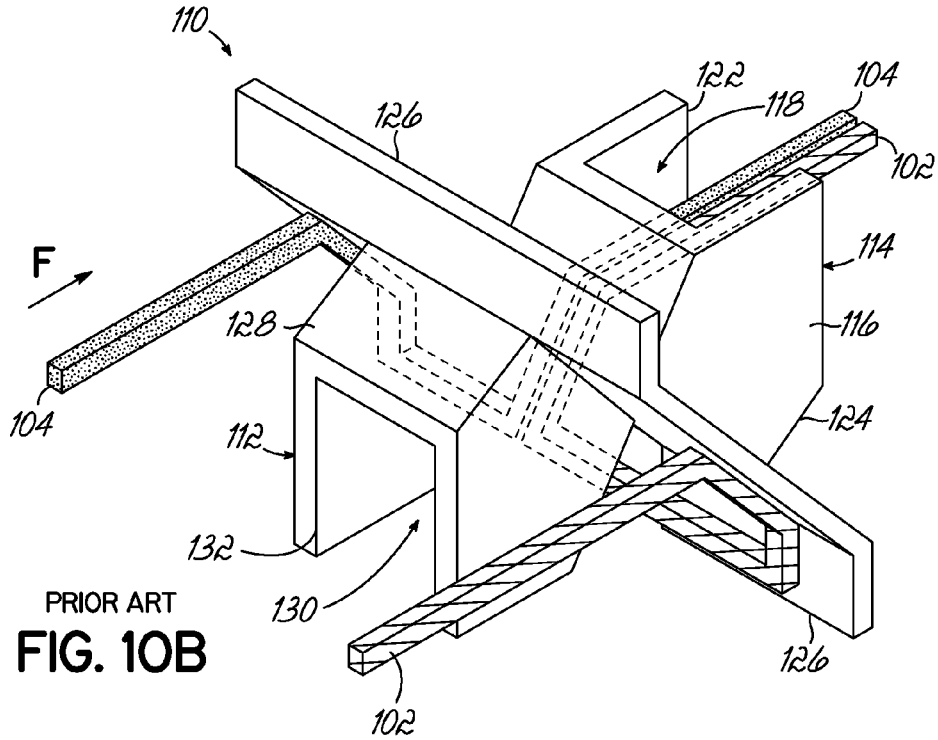
PRIOR ART FIG. 10B
FIG. 10B is a perspective view of the flow inversion baffle of FIG. 5A, further illustrating the flow paths of two peripheral streaks of fluid similar to the two peripheral streaks of FIG. 10A.

The cross flow inversion baffle 24 provides improved mixing effects compared to the flow inversion baffle 110 because the fluid in opposing halves of the perimeter of the initial mass fluid flow are directed towards opposing halves of the center of the mass fluid flow, while the center of the initial mass fluid flow is split and directed towards opposing halves of the perimeter of the mass fluid flow. A pair of examples is illustrated in FIGS. 10A-10D. FIGS. 10B and 10D illustrate the flow characteristics of the prior art flow inversion baffle 110 as fully disclosed in the Henning '156 patent. Referring to FIGS. 10A and 10B, a pair of perimeter fluid streaks 102, 104 traveling down opposing sides of the mixer conduit 12 is shown passing through the cross flow inversion baffle 24 and the flow inversion baffle 110 for comparison of the flow characteristics. As shown in FIG. 10A, the first fluid streak 102 flows past the first perimeter flow diverter 54 and through the second flow chamber 58, while the second fluid streak 104 flows past the second perimeter flow diverter 74 and through the fourth flow chamber 78. Upon exit from the respective flow chambers 58, 78, the first and second fluid streaks 102, 104 are each disposed in the center of the mass fluid flow but remain separated. In contrast, the pair of opposing fluid streaks 102, 104 in FIG. 10B travels down the same perimeter flow diverter 126 and together pass through the perimeter-to-center flow chamber 118. Upon exit from the flow inversion baffle 110, the first and second fluid streaks 102, 104 have combined into a unified streak at the center of the mass fluid flow. The unified streak of FIG. 10B must pass through a higher number of alternating mixing baffles 20, 22 to thoroughly diffuse the unified streak into the mass fluid flow compared to the separated streaks of FIG. 10A. The cross flow inversion baffle 24 consequently provides improved mixing of fluid in this scenario over the flow inversion baffle 110.

Figure 10C:
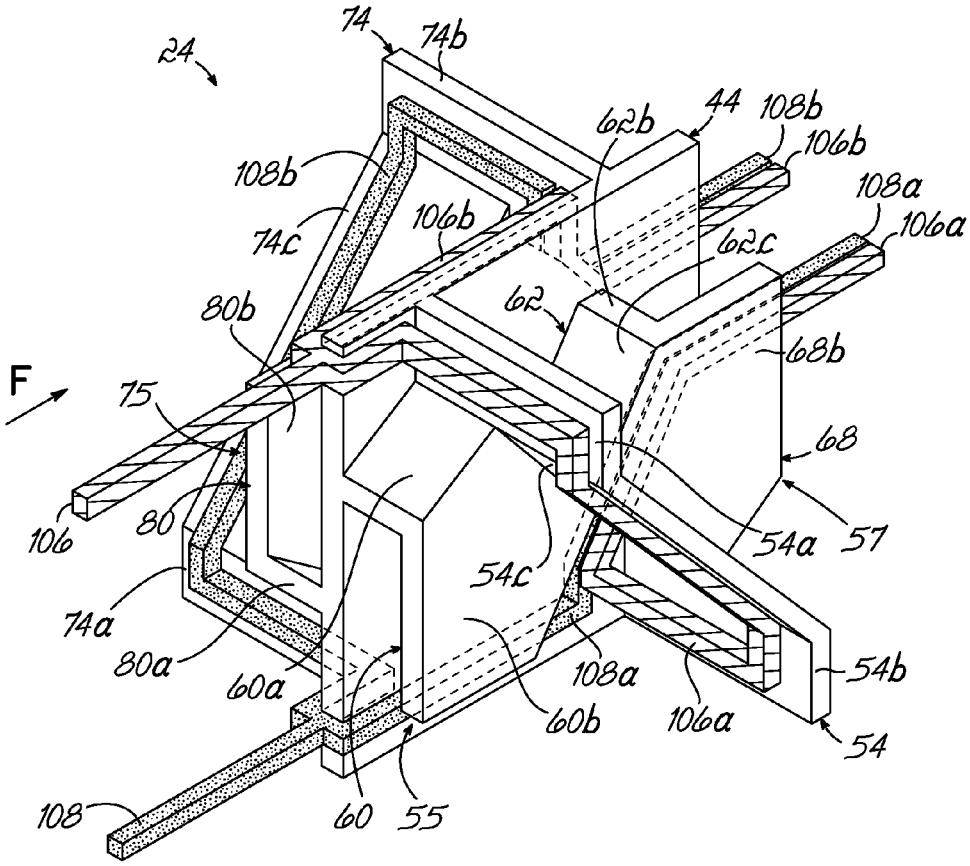
FIG. 10C is a perspective view of the cross flow inversion baffle of FIG. 6A, further illustrating the flow paths of two peripheral streaks of fluid located at the divider plate.
Figure 10D:
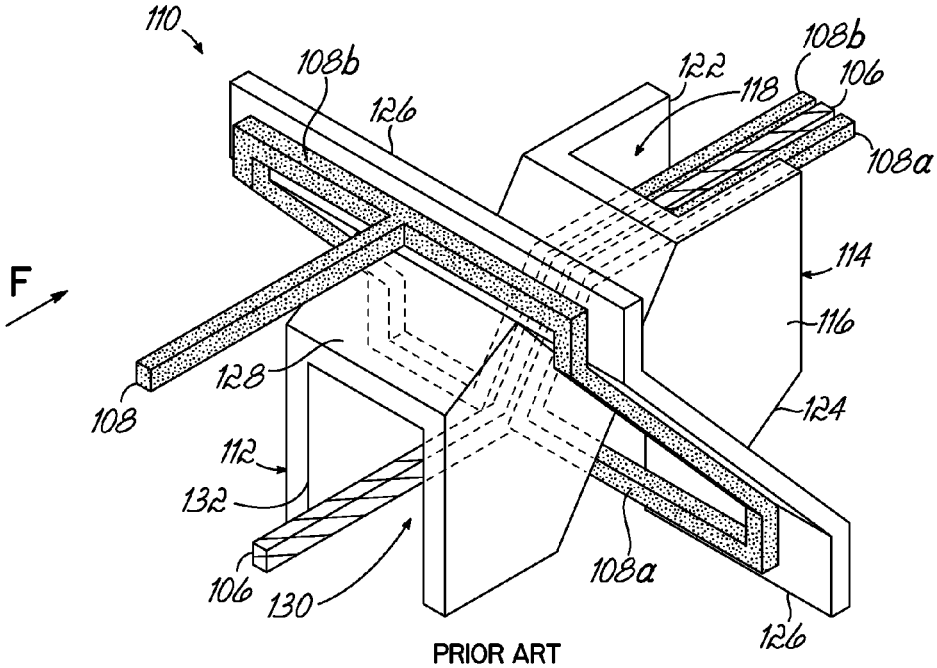
PRIOR ART FIG. 10D
FIG. 10D is a perspective view of the flow inversion baffle of FIG. 5A, further illustrating the flow paths of two peripheral streaks of fluid similar to the two peripheral streaks of FIG. 10C.

Another pair of perimeter fluid streaks 106, 108 is illustrated passing through the cross flow inversion baffle 24 and the flow inversion baffle 110 in FIGS. 10C and 10D for comparison of the flow characteristics. Each of the fluid streaks 106, 108 is divided into half fluid streaks 106*a*, 106*b*, 108*a*, 108*b* as the streaks 106, 108 encounter the divider wall 44 in FIGS. 10C and 10D. As shown in FIG. 10C, two of the half fluid streaks 106*a*, 108*a* flow past the first perimeter flow diverter 54 and through the second flow chamber 58, while the other two half fluid streaks 106*b*, 108*b* flow past the second perimeter flow diverter 74 and through the fourth flow chamber 78. Upon exit from the respective flow chambers 58, 78, the fluid streaks 106, 108 have been divided into two separate streaks in the center of the mass fluid flow as shown. In contrast, the fluid streaks 106, 108 in FIG. 10D come together at the perimeter flow diverter 126 and combine as they pass through the perimeter-to-center flow chamber 118. At the exit of the flow inversion baffle 110, the fluid streaks 106, 108 have combined into one combined streak in the center of the mass fluid flow. The combined streak of FIG. 10D must pass through a higher number of alternating mixing baffles 20, 22 to thoroughly diffuse the combined streak into the mass fluid flow compared to the separated streaks of FIG. 10C. Again, the cross flow inversion baffle 24 provides improved mixing of fluid in this scenario over the flow inversion baffle 110.

Thus, the cross flow inversion baffle 24 further addresses the streaking phenomenon of fluid passing through the static mixer 10 without being thoroughly mixed, thereby improving the effectiveness of the static mixer 10. The cross flow inversion baffle 24 may also be used with fewer overall mixing baffles 20, 22, 24 in the static mixer 10 to provide a similar quality of mixing as a static mixer with more overall mixing baffles 20, 22, 110 including the flow inversion baffle 110. With fewer overall mixing baffles 20, 22, 24, the length of the static mixer 10 can be advantageously reduced. As with the flow inversion baffle 110, the cross flow inversion baffle 24 has been described above for a square-shaped mixer conduit 12. However, the shape of the cross flow inversion baffle 24 and the alternating mixing baffles could be modified for alternative embodiments of static mixer conduits 12.

Figure 11:
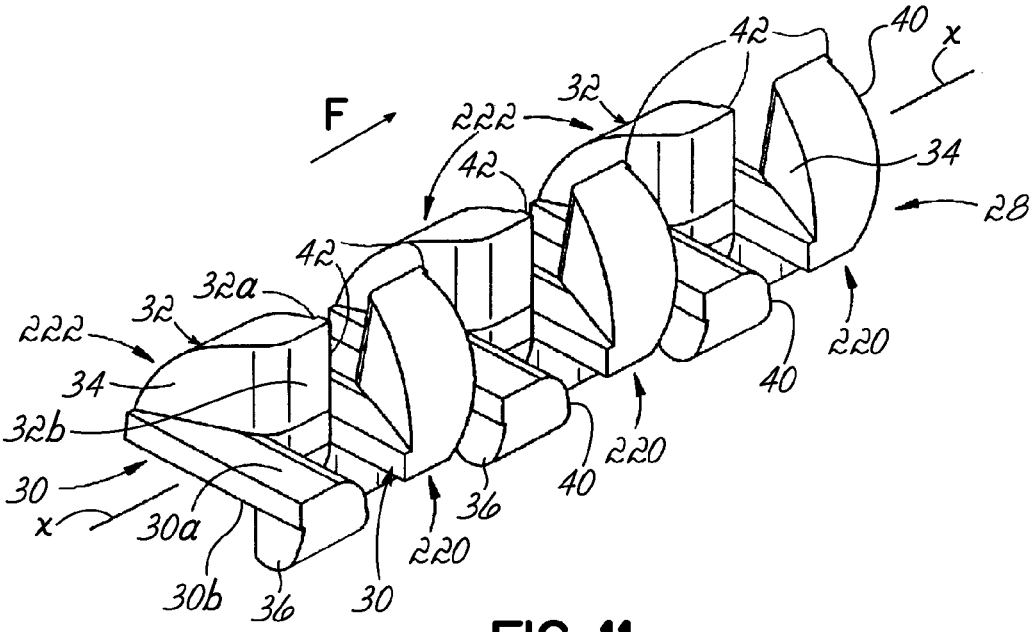
FIG. 11 is a perspective view of another embodiment of interconnected alternating mixing baffles adapted for a round mixer conduit.

In the following alternative embodiments, the same reference numerals from previous embodiments are used where the elements referenced only change in shape. One alternative embodiment of a cross flow inversion baffle 224 and alternating mixing baffles 220, 222 adapted for a round mixer conduit are illustrated in FIGS. 11 and 12A-12D. As shown in FIG. 11, the alternating mixing baffles 220, 222 include each of the same elements as the alternating mixing baffles 20, 22 of FIGS. 2-4. A round cross flow inversion baffle 224 adapted for these alternating mixing baffles 220, 222 is illustrated shown in FIGS. 12A-12D. The round cross flow inversion baffle 224 includes each of the same elements as the cross flow inversion baffle 24 described above, but the chamber walls have been rounded to mix a mass fluid flow traveling in a round mixer conduit 12. One skilled in the art will appreciate that the round cross flow inversion baffle 224 may be used with many other kinds of mixing baffles, including left and right-handed spiral mixing baffles.

Figure 13:
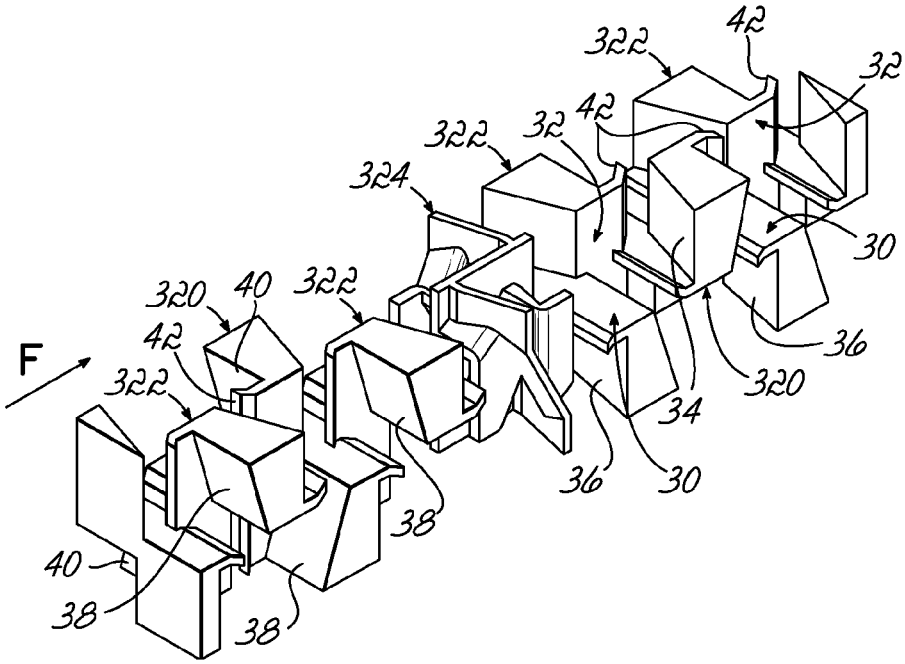
FIG. 13 is a perspective view of another embodiment of interconnected alternating mixing baffles adapted for a rectangular mixer conduit.
Figure 12A:
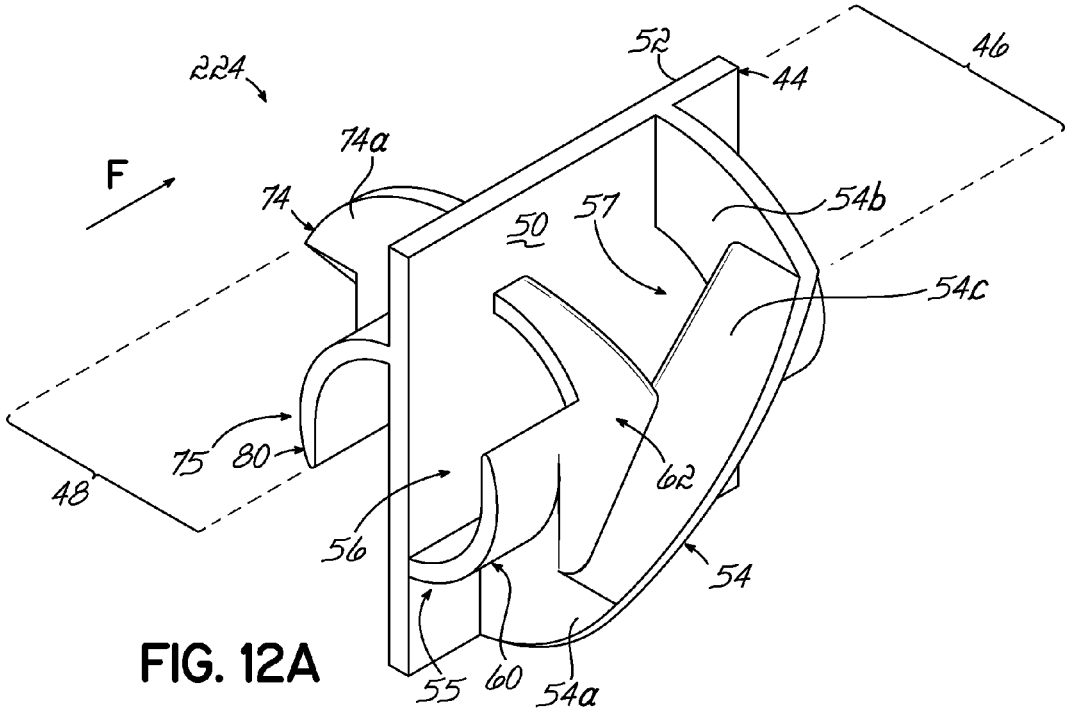
FIG. 12A is a perspective view of an alternative embodiment of a cross flow inversion baffle for a round mixer conduit.
Figure 12B:
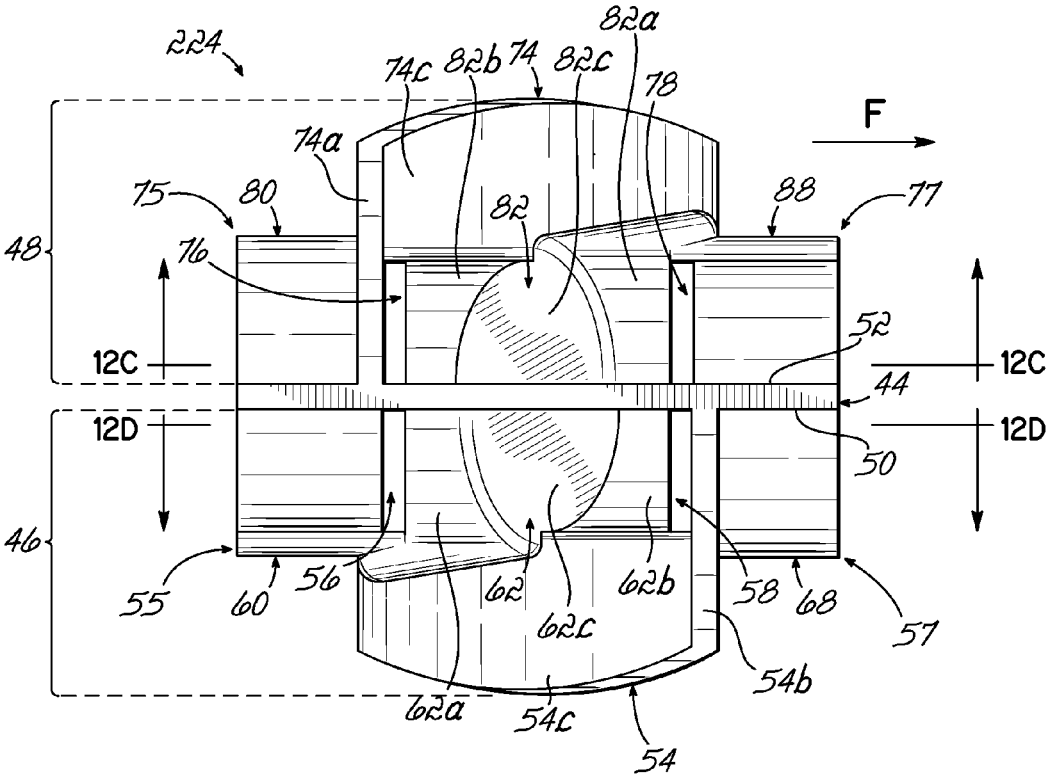
FIG. 12B is a top view of the cross flow inversion baffle of FIG. 12A.
Figure 12C:
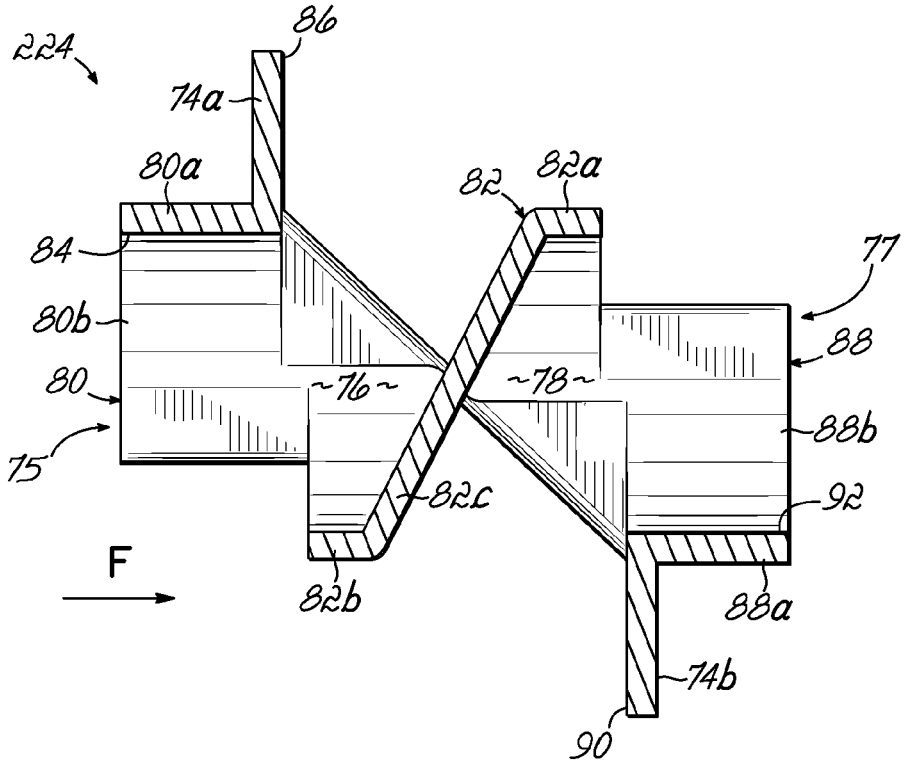
FIG. 12C is a cross-sectional side view of the cross flow inversion baffle of FIG. 12B along line 12C-12C.
Figure 12D:
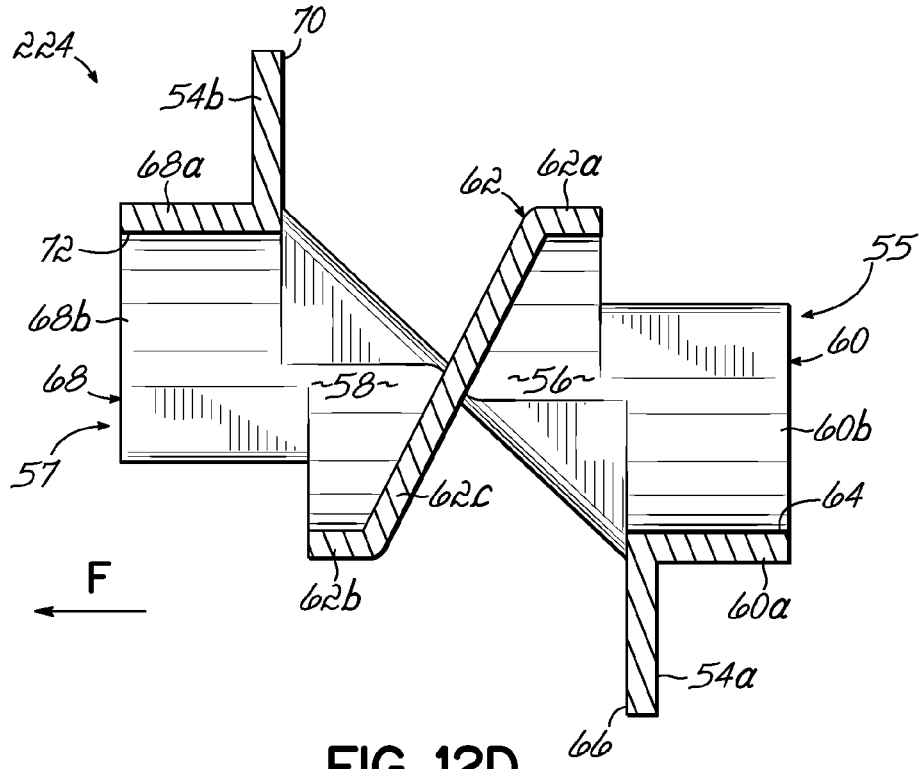
FIG. 12D is a cross-sectional side view of the cross flow inversion baffle of FIG. 12B along line 12D-12D.
Figure 14A:
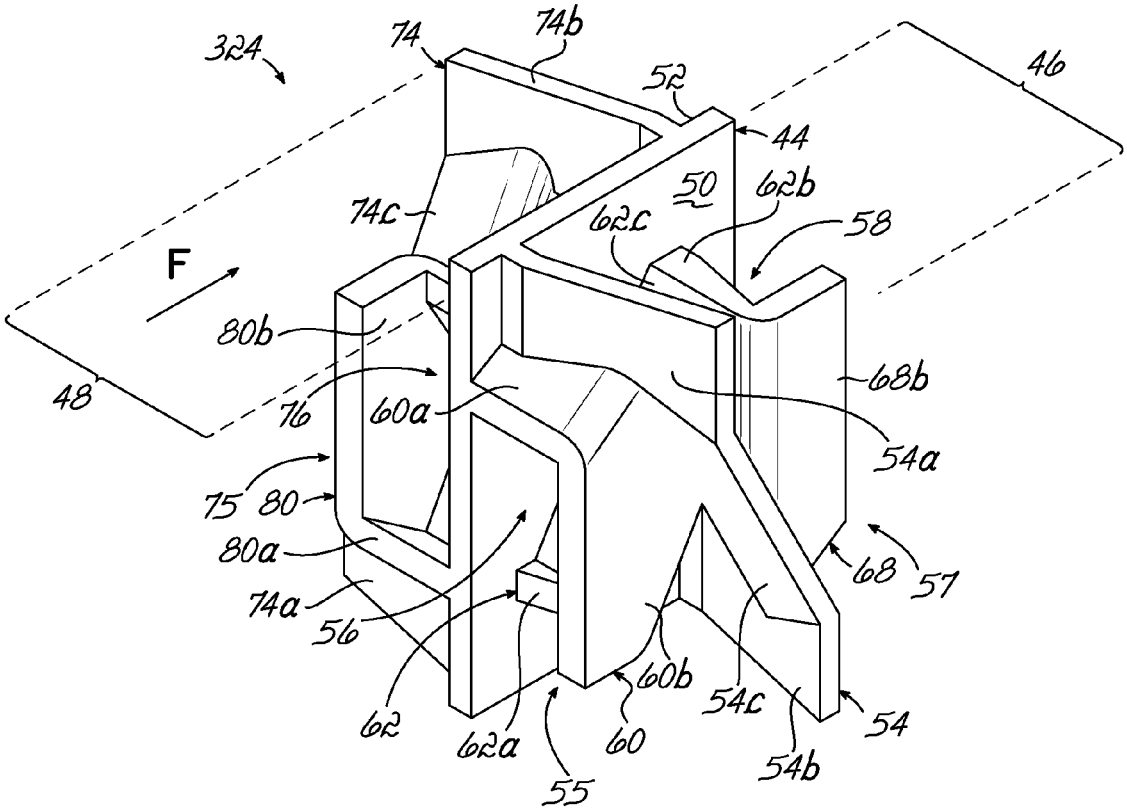
FIG. 14A is a perspective view of an alternative embodiment of a cross flow inversion baffle for a rectangular mixer conduit.
Figure 14B:
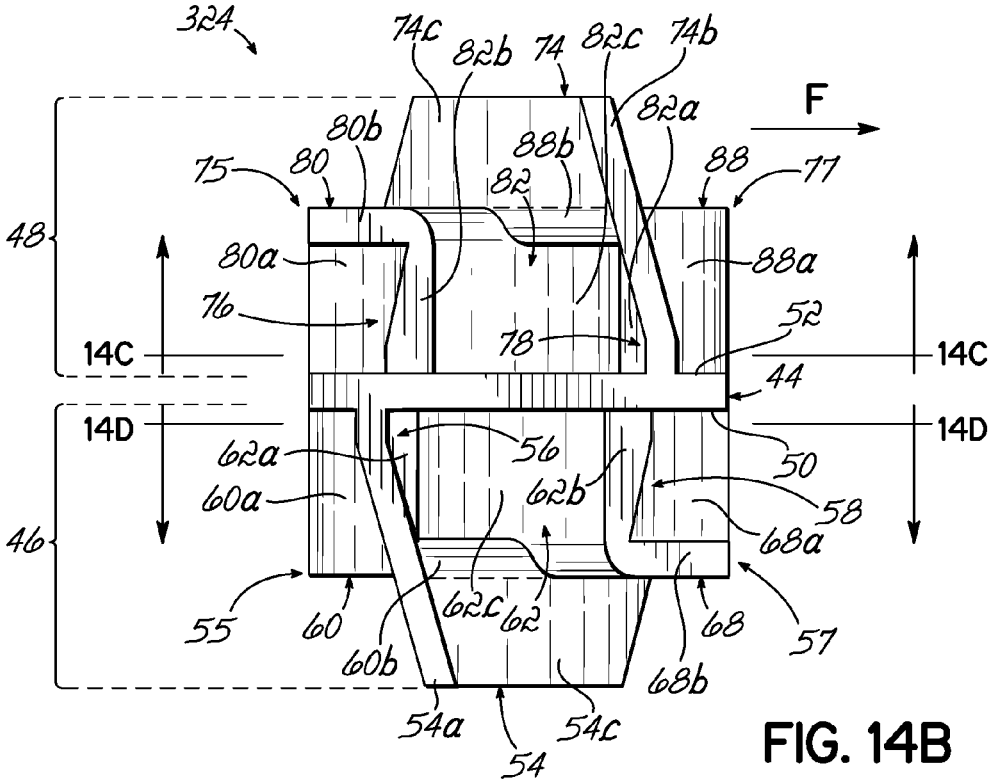
FIG. 14B is a top view of the cross flow inversion baffle of FIG. 14A.
Figure 14C:
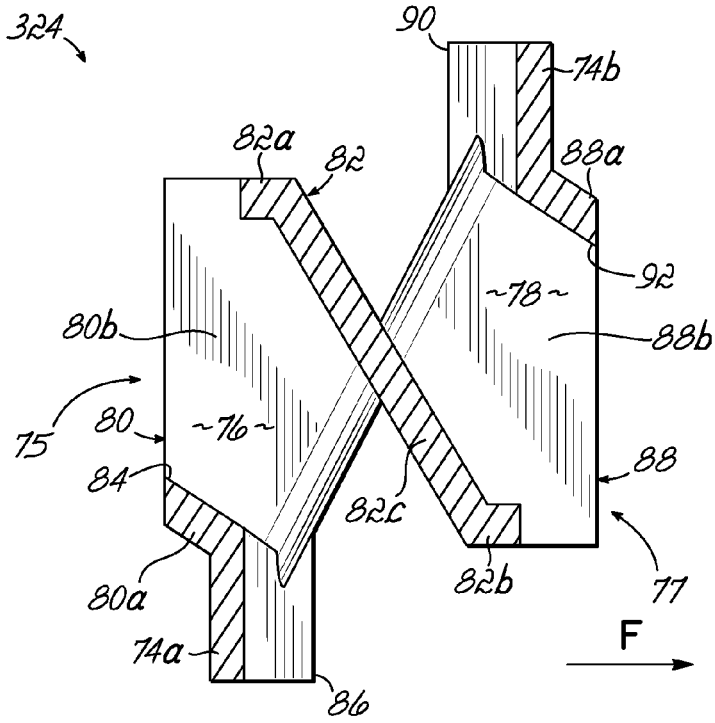
FIG. 14C is a cross-sectional side view of the cross flow inversion baffle of FIG. 14B along line 14C-14C.
Figure 14D:
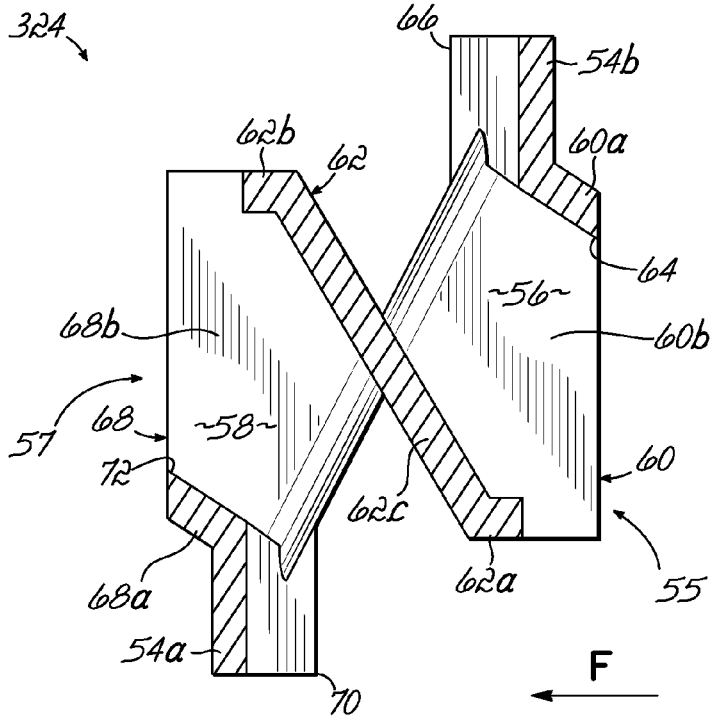
FIG. 14D is a cross-sectional side view of the cross flow inversion baffle of FIG. 14B along line 14D-14D.

Another alternative embodiment of a cross flow inversion baffle 324 and alternating mixing baffles 320, 322 are illustrated in FIGS. 13 and 14A-14D. As shown in FIG. 13, the alternating mixing baffles 320, 322 are adapted for a rectangular mixer conduit like the mixing baffles 20, 22 described previously, but the alternating mixing baffles 320, 322 reverse orientation with respect to flow direction on opposite sides of the cross flow inversion baffle 324. The cross flow inversion baffle 324 is illustrated in FIGS. 14A-14D and includes rounded or contoured chamber walls. The cross flow inversion baffle 324 includes each of the same elements as the cross flow inversion baffle 24 described above. One skilled in the art will appreciate that the cross flow inversion baffle 324 of this embodiment may be used in combination with the mixing baffles 20, 22 of the previous embodiment, or any other appropriately-shaped mixing baffles.

While the present invention has been illustrated by a description of several embodiments, and while such embodiments have been described in considerable detail, there is no intention to restrict, or in any way limit, the scope of the appended claims to such detail. Additional advantages and modifications will readily appear to those skilled in the art. For example, the cross flow inversion baffle 24 can be adapted for use in any type of mixer conduit 12, including rectangular-shaped and circular-shaped. Additionally, the cross flow inversion baffle 24 may be used with different types of alternating mixing baffles than the ones described in various embodiments above, including spiral mixing baffles. Therefore, the invention in its broadest aspects is not limited to the specific details shown and described. The various features disclosed herein may be used in any combination necessary or desired for a particular application. Consequently, departures may be made from the details described herein without departing from the spirit and scope of the claims which follow.

What is claimed is:

1. A cross flow inversion baffle for mixing a fluid flow, comprising:

a divider wall having a first side and a second side;

a first perimeter flow diverter;

a first center-to-perimeter flow portion disposed at least partially between the first perimeter flow diverter and the first side of the divider wall, the first center-to-perimeter flow portion including a first chamber wall defining a first flow chamber;

a first perimeter-to-center flow portion disposed at least partially between the first perimeter flow diverter and the first side of the divider wall, the first perimeter-to-center flow portion including a second chamber wall defining a second flow chamber;

a second perimeter flow diverter;

a second center-to-perimeter flow portion disposed at least partially between the second perimeter flow diverter and the second side of the divider wall, the second center-to-perimeter flow portion including a third chamber wall defining a third flow chamber; and a second perimeter-to-center flow portion disposed at least partially between the second perimeter flow diverter and the second side of the divider wall, the second perimeter-to-center flow portion including a fourth chamber wall defining a fourth flow chamber;

wherein the fluid flow is divided by the divider wall, and fluid flowing in the center of the fluid flow moves to the perimeter of the fluid flow through the first and third flow chambers, and fluid flowing in the perimeter of the fluid flow moves to the center of the fluid flow through the second and fourth flow chambers.

2. The cross flow inversion baffle of claim 1, wherein the divider wall, the first and second perimeter flow diverters, the first and second center-to-perimeter flow portions, and the first and second perimeter-to-center flow portions are integral with one another.

3. The cross flow inversion baffle of claim 1, wherein the divider wall, the first and second perimeter flow diverters, the first and second center-to-perimeter flow portions, and the first and second perimeter-to-center flow portions are injection molded.

4. The cross flow inversion baffle of claim 1, wherein the first perimeter flow diverter, the first center-to-perimeter flow portion, and the first perimeter-to-center flow portion collectively define a first cross flow inverter half, and the second perimeter flow diverter, the second center-to-perimeter flow portion, and the second perimeter-to-center flow portion collectively define a second cross flow inverter half.

5. The cross flow inversion baffle of claim 4, wherein the first and second cross flow inverter halves are substantially identical and the second cross flow inverter half is rotated 180 degrees from the orientation of the first cross flow inverter half.

6. A static mixer for mixing a fluid flow, comprising:

a mixer conduit;

a plurality of mixing baffles disposed in the conduit; and at least one cross flow inversion baffle disposed in the conduit, each cross flow inversion baffle further comprising:

a divider wall having a first side and a second side;

a first perimeter flow diverter;

a first center-to-perimeter flow portion disposed at least partially between the first perimeter flow diverter and the first side of the divider wall, the first center-to-perimeter flow portion including a first chamber wall defining a first flow chamber;

a first perimeter-to-center flow portion disposed at least partially between the first perimeter flow diverter and the first side of the divider wall, the first perimeter-to-center flow portion including a second chamber wall defining a second flow chamber;

a second perimeter flow diverter;

a second center-to-perimeter flow portion disposed at least partially between the second perimeter flow diverter and the second side of the divider wall, the second center-to-perimeter flow portion including a third chamber wall defining a third flow chamber; and a second perimeter-to-center flow portion disposed at least partially between the second perimeter flow diverter and the second side of the divider wall, the second perimeter-to-center flow portion including a fourth chamber wall defining a fourth flow chamber, wherein the fluid flow is divided by the divider wall, and fluid flowing in the center of the fluid flow moves to the perimeter of the fluid flow through the first and third flow chambers, and fluid flowing in the perimeter of the fluid flow moves to the center of the fluid flow through the second and fourth flow chambers.

7. The static mixer of claim 6, wherein the plurality of mixing baffles comprises alternating mixing baffles including at least one right-handed baffle and at least one left-handed baffle.

8. The static mixer of claim 6, wherein the plurality of mixing baffles and the at least one cross flow inversion baffle are formed integrally.

9. The static mixer of claim 6, wherein the plurality of mixing baffles and the at least one cross flow inversion baffle are formed by injection molding.

10. The static mixer of claim 9, further comprising a conduit sidewall integrally formed with the plurality of mixing baffles and the at least one cross flow inversion baffle.

* * * * *